US007386132B2

(12) United States Patent
Griesinger

(10) Patent No.: US 7,386,132 B2
(45) Date of Patent: Jun. 10, 2008

(54) 5-2-5 MATRIX ENCODER AND DECODER SYSTEM

(75) Inventor: David H. Griesinger, Cambridge, MA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 11/499,950

(22) Filed: Aug. 7, 2006

(65) Prior Publication Data

US 2006/0274900 A1 Dec. 7, 2006

Related U.S. Application Data

(63) Continuation of application No. 10/687,676, filed on Oct. 17, 2003, now Pat. No. 7,107,211, which is a continuation of application No. 09/146,442, filed on Sep. 3, 1998, now Pat. No. 6,697,491, which is a continuation-in-part of application No. 08/684,948, filed on Jul. 19, 1996, now Pat. No. 5,796,844.

(60) Provisional application No. 60/058,169, filed on Sep. 5, 1997.

(51) Int. Cl.
*H04S 5/00* (2006.01)

(52) U.S. Cl. ..... 381/18; 381/22

(58) Field of Classification Search ..... 381/18, 381/22

See application file for complete search history.

(56) References Cited

U.S. PATENT DOCUMENTS 3,934,086 A 1/1976 Takahashi
3,982,069 A 9/1976 Takahashi
4,021,612 A 5/1977 Takahashi
4,152,542 A 5/1979 Cooper
4,862,502 A 8/1989 Griesinger
5,136,650 A 8/1992 Griesinger
5,216,718 A 6/1993 Fukuda
5,638,452 A 6/1997 Waller, Jr.

(Continued)

FOREIGN PATENT DOCUMENTS

EP 0782372 2/1997

(Continued)

OTHER PUBLICATIONS

Notice of Submission of Opinion for corresponding Korean Patent Application No. 7002377/2000, dated Jun. 30, 2003, 2 pages, (translation and original submitted).

*Primary Examiner*—Susan McFadden
(74) *Attorney, Agent, or Firm*—Brinks, Hofer, Gilson & Lione

(57) ABSTRACT

A sound reproduction system has been developed, for converting signals on two input channels into surround signals on five or seven output channels and vice-versa. A decoder is included in the sound reproduction system which enhances the correlated component of the input signals in the desired direction and reduces the strength of such signals in channels not associated with the encoded direction, while preserving the apparent loudness of all output channels, the separation between the respective left and right output channels and the total energy of the uncorrelated component of the input channels in each output channel. The decoder may include a uniquely defined matrix that helps to ensure that the surface of the output signals is smooth and continuous.

30 Claims, 17 Drawing Sheets

U.S. PATENT DOCUMENTS

| | | | |
|---|---|---|---|
| 5,644,640 | A | 7/1997 | Fosgate |
| 5,771,295 | A | 6/1998 | Waller, Jr. |
| 5,796,844 | A | 8/1998 | Griesinger |
| 5,870,480 | A | 2/1999 | Griesinger |
| 6,198,827 | B1 | 3/2001 | Waller, Jr. |

FOREIGN PATENT DOCUMENTS

| | | |
|---|---|---|
| EP | 0 533 757 B1 | 9/1998 |
| JP | 5-60098 | 8/1993 |
| JP | 8-51698 | 2/1996 |
| WO | WO 09119407 A | 12/1991 |
| WO | WO 9215180 A | 9/1992 |

5-2-5 MATRIX ENCODER AND DECODER SYSTEM

PRIORITY CLAIM

This application is a continuation of U.S. patent application Ser. No. 10/687,676, filed Oct. 17, 2003 now U.S. Pat. No. 7,107,211 (hereby incorporated by reference in its entirety), which is a continuation of U.S. patent application Ser. No. 09/146,442, entitled "5-2-5 Matrix Encoder and Decoder System" filed Sep. 3, 1998 now U.S. Pat. No. 6,697,491 (hereby incorporated by reference), which claims the benefit of U.S. Provisional Patent Application No. 60/058,169, entitled "5-2-5 Matrix Encoder and Decoder System" filed Sep. 5, 1997, and is a continuation-in-part of U.S. patent application Ser. No. 08/684,948, entitled "Multichannel Active Matrix Sound Reproduction with Maximum Lateral Separation" filed Jul. 19, 1996 (now issued U.S. Pat. No. 5,796,844).

BACKGROUND OF THE INVENTION

This invention relates to sound reproduction systems involving the decoding of a stereophonic pair of input audio signals into a multiplicity of output signals for reproduction after suitable amplification through a like plurality of loudspeakers arranged to surround a listener, as well as the encoding of multichannel material into two channels.

SUMMARY

The present invention concerns an improved set of design criteria and their solution to create a decoding matrix having optimum psychoacoustic performance in reproducing encoded multichannel material as well as standard two channel material. This decoding matrix maintains high separation between the left and right components of stereo signals under all conditions, even when there is a net forward or rearward bias to the input signals, or when there is a strong sound component in a particular direction, while maintaining high separation between the various outputs for signals with a defined direction, and non-directionally encoded components at a constant acoustic level regardless of the direction of the directionally encoded components of the input audio signals. The decoding matrix includes frequency dependent circuitry that improves the balance between front and rear signals, provides smooth sound motion around a seven channel version of the system, and makes the sound of a five channel version closer to that of a seven channel version.

Additionally, this invention concerns an improved set of design criteria and their solution to create an encoding circuit for the encoding of multi-channel sound into two channels for reproduction in standard two channel receivers and by matrix decoders.

The present invention is part of a continuing effort to refine the encoding of multichannel audio signals into two separate channels, and the separation of the resulting two channels back into the multichannel signals from which they were derived. One of the goals of this encode/decode process is to recreate the original signals as perceptually identical to the originals as possible. Another important goal of the decoder is to extract five or more separate channels from a two channel source that was not encoded from a five channel original. The resulting five channel presentation must be at least as musically tasteful and enjoyable as the original two channel presentation.

The derivation of suitable variable matrix coefficients and the variable matrix coefficients themselves have been improved. To assist the understanding of these improvements, this document makes reference to U.S. Pat. No. 4,862,502 (1989) (referred to in this document as the "'89 patent"); U.S. Pat. No. 5,136,650 (1992) (referred to in this document as the "'92 patent"); U.S. patent application Ser. No. 08/684,948, filed in July 1996 (now issued U.S. Pat. No. 5,796,844 (1998)) (referred to in this document as the "July '96 application"); and U.S. patent application Ser. No. 08/742,460 (now issued U.S. Pat. No. 5,870,480 (1999)) (referred to in this document as the "November '96 application"). Commercial versions of the decoder based upon the November '96 application will be referred to in this document as "Version 1.11" or "V1.11". Some further improvements were disclosed in Provisional Patent Application 60/058,169, filed September 1997 (referred to in this document as "Version 2.01" or "V2.01." Further, Versions V1.11 and V2.01, and the decoders presented in this application will be referred to in this document collectively as the "Logic 7® decoders." Additionally, the following are referenced in this application: [1] "Multichannel Matrix Surround Decoders for Two-Eared Listeners," David Griesinger, AES preprint #4402, October, 1996, and [2] "Progress in 5-2-5 Matrix Systems," David Griesinger, AES preprint #4625, September, 1997.

An active matrix having certain properties that maximize its psychoacoustic performance has been realized. Additionally, frequency dependent modifications of certain outputs of the active matrix have also been realized. Further, active circuitry that encodes five input channels into two output channels is provided that will perform optimally with the decoders presented in this application, standard two channel equipment, and industry standard Dolby® Pro-Logic® decoders.

The active matrix decoder has matrix elements that vary depending on the directional component of the incoming signals. The matrix elements vary to reduce the loudness of directionally encoded signals in outputs that are not involved in producing the intended direction, while enhancing the loudness of these signals in outputs that are involved in reproducing the intended direction, while at all times preserving the left/right separation of any simultaneously occurring input signals. Moreover, these matrix elements restore the left/right separation of decorrelated two channel material, which has been directionally encoded, by increasing or decreasing the blend between the two inputs. For example, restoration is achieved using stereo width control. In addition, these matrix elements may be designed to preserve the energy balance between the various components of the input signal, as much as possible, so that the balance between vocals and accompaniment is preserved in the decoder outputs. As a consequence, these matrix elements preserve both the loudness and the left/right separation of the non-directionally encoded elements of the input sound.

Additionally, the decoders may include frequency dependent circuits that improve the compatibility of the decoder outputs when standard two channel material is played, that convert the inputs into two surround outputs (a five channel decoder) or four surround outputs (a seven channel decoder), and that modify the spectrum of the rear channels in a five channel decoder so that the sound direction is perceived to be more like the sound direction produced by a seven channel decoder.

The encoders mix five (or five full-range plus one low frequency) input channels into two output channels so that the energy of that input is preserved in the output when the input level of a particular input is strong; the direction of a strong input is encoded in the phase/amplitude ratio of the output signals; the strong signals can be panned between any two inputs of the encoder, and the output will be correctly directionally encoded. In addition, decorrelated material applied to the two rear inputs of the encoder will be encoded into two output channels so that the left/right separation of the inputs will be preserved when the encoder output is decoded by the decoders presented in this document; in-phase inputs will produce a two channel output that will be decoded to the rear channels of the decoders presented in this document and decoders using the Dolby® standard; anti-phase inputs will produce outputs that will be decoded as a non-directional signal when decoded by the decoders presented in this document or by decoders using the Dolby® standard; and low level reverberant signals applied to the two rear inputs of the encoder will be encoded with a 3 dB level reduction Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

1. General Description of the Decoder

The decoder will be described in terms of two separate parts. The first part is a matrix that splits two input channels into five output channels (the input channels are usually identified as center, left front, right front, left rear, and right rear). The second part consists of a series of delays and filters that modify the spectrum and the levels of the two rear outputs. One of the functions of the second part is to derive an additional pair of outputs, a left side and a right side, to produce a seven channel version of the decoder. In contrast, the two additional outputs described in the November '96 application were derived from an additional pair of matrix elements, which were included in the original matrix.

In the mathematical equations describing the decoder and encoder the standard typographical conventions will be used for most variables. Simple variables will be in italic type, vector quantities will be in bold lower case type, and matrixes will be in bold upper case type. Matrix elements that are coefficients from a named output channel resulting from a named input channel will be in normal upper case type. Some simple variables such as lr and cs will be indicated by two-letter names that do not represent the product of two separate simple variables. Other variables, such as l/r and c/s, represent the values of left-right and center-surround ratios in terms of control signal voltages derived from these ratios. These conventions have also been used in the patents and patent applications cited in this document. Program segments in the Matlab language will also be distinguished by the use of indented lines. Equations will be numbered to distinguish them from Matlab assignment statements, and to provide a reference for specific features.

Figure 1:
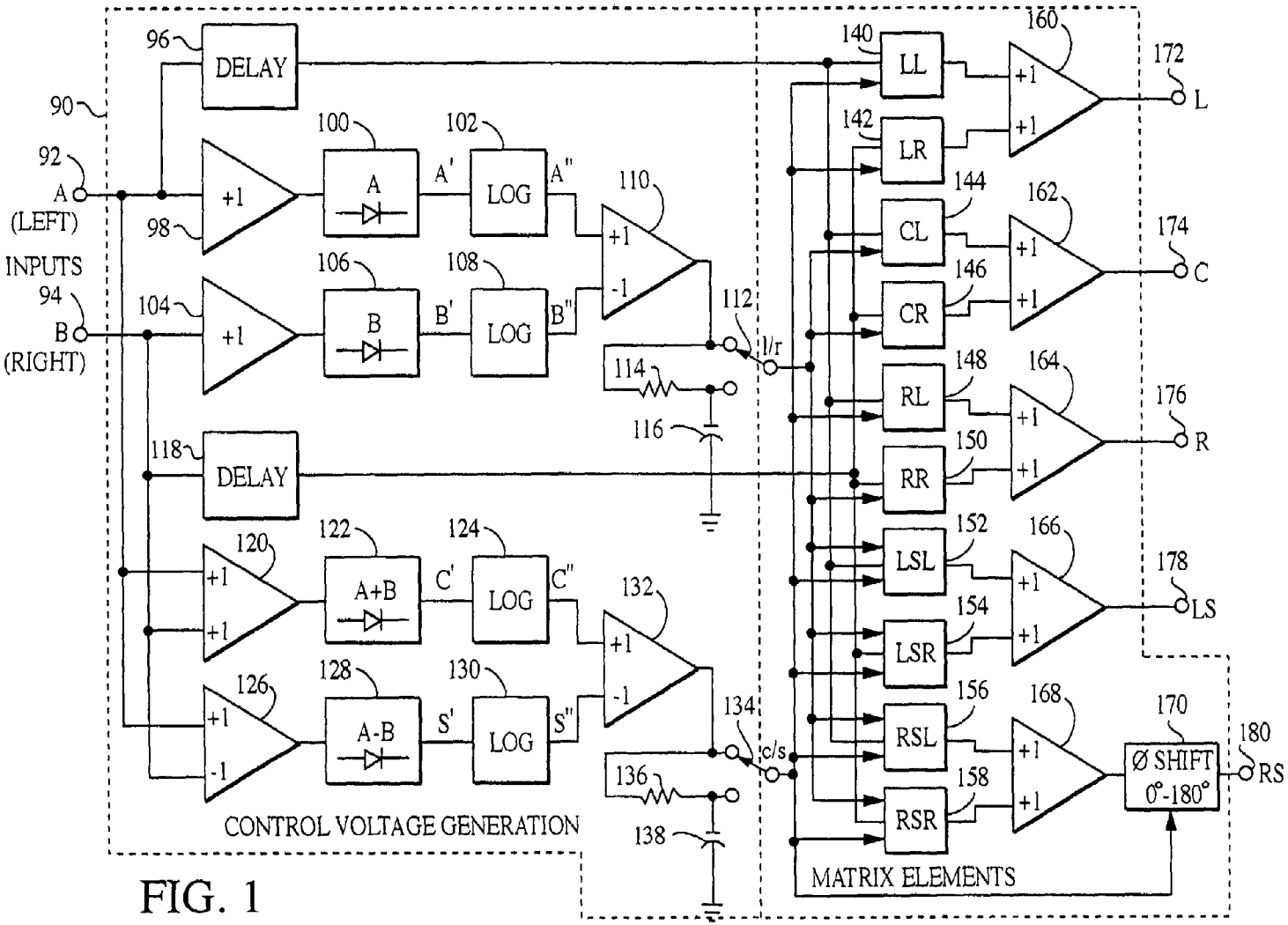
FIG. 1 is a block diagram of a direction detection section and a two to five channel matrix section of a decoder.

FIG. 1 is a block diagram of the first part of the decoder, which is a two channel to five channel matrix 90. The left half of FIG. 1, partitioned by a vertical dashed line, shows a circuit for deriving the two steering voltages l/r and c/s. These steering voltages represent the degree to which the input signals have an inherent or encoded directional component in the left/right or front/back directions, respectively. This part of FIG. 1 will not be explicitly discussed in this application, because it has been fully described in the patent and patent applications cited in this document, which are incorporated by reference.

In FIG. 1 the directional detection circuit of decoder 90 comprising elements 92 through 138 is followed by a 5×2 matrix (shown to the right of the vertical dashed line). The elements of this matrix, 140 through 158, determine the amount of each input channel linearly combined with another input channel to form each output channel. These matrix elements are assumed to be real (the case of complex matrix elements is described in the November '96 application). The matrix elements are functions of the two steering voltages l/r and c/s, mathematical formulae for which are presented in the November '96 application. Improvements have been made to these formulae.

2. A Brief Description of the Steering Voltages

As shown in FIG. 1, the steering voltages c/s and l/r are derived from the logarithm of the ratio of the left input amplitude at terminal 92 to the right input amplitude at terminal 94, and the logarithm of the ratio of the sum amplitude (the sum of the left input amplitude and the right input amplitude) to the difference amplitude (the difference between the left input amplitude and the right input amplitude). In V1.11 and V2.01, the unit of the steering voltages is decibels. However, when describing the matrix elements, it is convenient to express l/r and c/s as angles that vary from +45 degrees to −45 degrees. The steering voltages l/r and c/s can be converted into angles lr and cs, respectively, according to the following equations:

$$lr=90-\arctan(10\hat{}((l/r)/20)) \tag{1a}$$

$$cs=90-\arctan(10\hat{}((c/s)/20)) \tag{1b}$$

The angles lr and cs determine the degree to which the input signals have a directional component. For example, when the inputs to the decoder are decorrelated, both lr and cs are zero. For a signal that comes from the center only, lr is zero, and cs is 45 degrees. For a signal that comes from the rear, lr is zero, and cs is −45 degrees. Similarly, for a signal that comes from the left, lr is 45 degrees and cs is zero, and for a signal that comes from the right, lr is −45 degrees, and cs is zero. It may be assumed that the input was encoded so that lr=22.5 degrees and cs=−22.5 degrees for left rear signals, and lr=−22.5 degrees, and cs=−22.5 degrees for right rear signals.

Due to the definitions of l/r and c/s and the derivation of lr and cs, the sum of the absolute value of lr and cs cannot be greater than 45 degrees. Therefore, the allowed values of lr and cs form a surface bounded by the locus of abs(lr)−abs(cs)=45 degrees. Any input signal that produces values of lr and cs that lie along the boundary of this surface is fully localized, which means that the input signal consists of a single sound that has been encoded to come from a particular direction.

In this application extensive use will be made of graphs depicting the matrix elements as functions over this two dimensional surface. In general, the derivation of the matrix elements will be different in the four quadrants of this surface. In other words, the matrix elements are described differently depending on whether the steering is to the front or to the rear, and whether the steering is to the left or the right. Considerable work is devoted to insuring that the surface is continuous across the boundaries between quadrants, thus addressing the occasional lack of continuity experienced by V1.11.

3. Frequency Dependent Elements

The matrix elements shown in FIG. 1 are real and thus frequency independent. All signals in the inputs will be directed to the outputs depending on the derived angles lr and cs. Additionally, low frequencies and very high frequencies may be attenuated in the derivation of lr and cs from the input signals by filters not shown in FIG. 1. However, the matrix itself is broadband.

Figure 2:
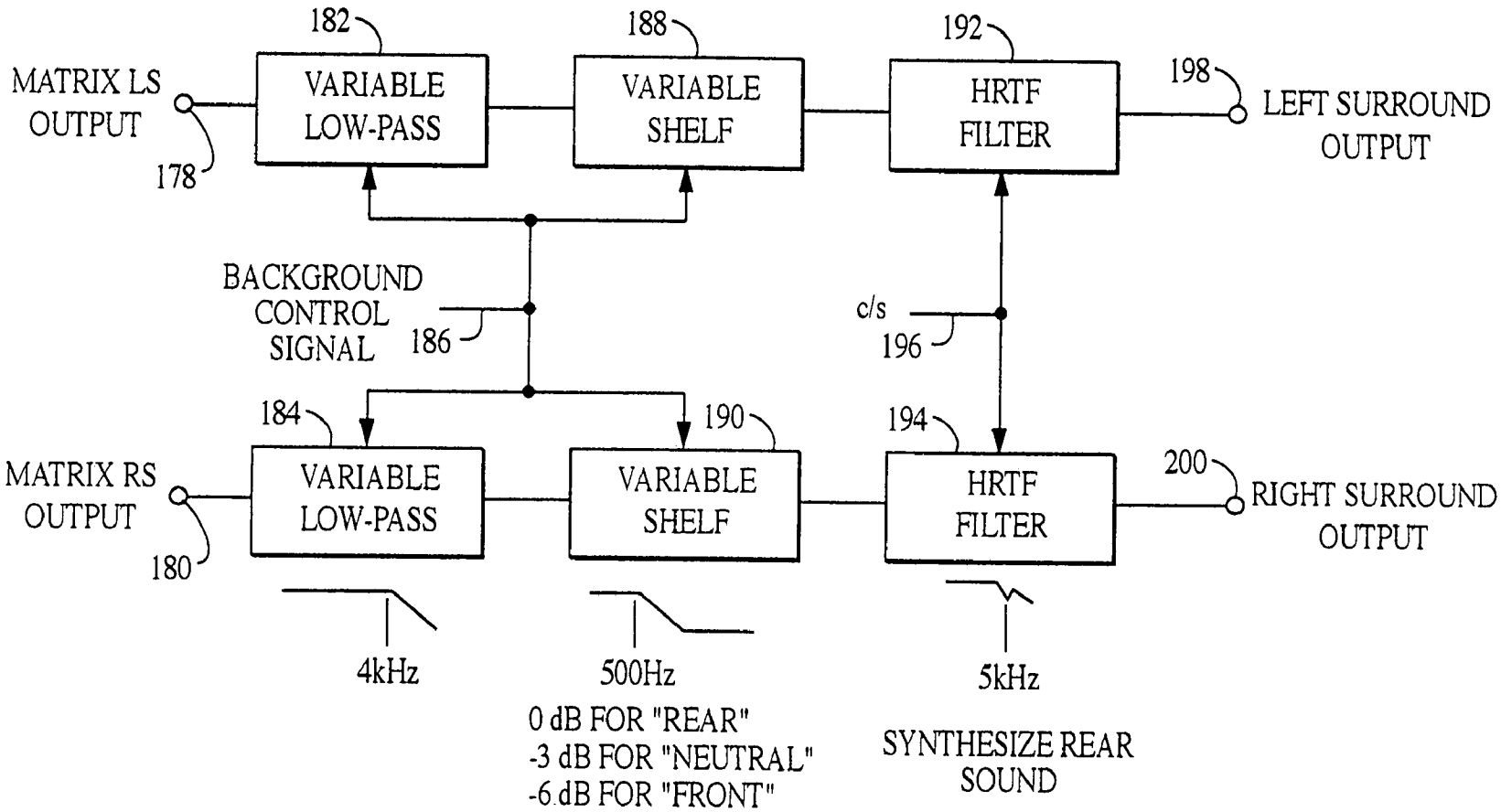
FIG. 2 is a block diagram of a five-channel frequency-dependent active signal processor circuit, which may be connected between the outputs of the matrix section of FIG. 1 and the decoder outputs.

There are several advantages to applying frequency dependent circuits to the signals after the matrix. One of these frequency dependent circuits, the phase shift network 170 at the right side output 180 in FIG. 1, is described in the November '96 application. A five channel version of the additional frequency dependent circuits is shown in FIG. 2. These circuits do not have fixed parameters and the frequency and level behavior is dependent on the steering angles lr and cs. The frequency dependent circuits accomplish several purposes. First, in both a five channel and a seven channel decoder, the additional elements allow the apparent loudness of the rear channels to be adjusted when the steering is neutral (lr and cs 0) or toward the front (cs>0). In the November '96 application, this attenuation was performed as part of the matrix itself and was frequency independent. It has been found through theoretical studies and listening tests that it is highly desirable for the low frequencies to be reproduced from the sides of the listener. Thus, in the decoder presented here, only the high frequencies are attenuated by variable low pass filters 182, 184, 188, and 190.

The high frequencies are attenuated in the rear channels when the steering is nearly always neutral or forward. Elements 188 and 190 attenuate the frequencies above 500 Hz and elements 182 and 184 attenuate the frequencies above 4 kHz using a background control signal 186 (to be defined later). The occasional presence of sounds that are steered rearwards reduces the attenuation, which is a feature that automatically distinguishes surround encoded material from ordinary two channel material.

Elements 192 and 194, in the five channel version modify the spectrum of the sound when the steering is toward the rear (cs<0) using the c/s signal 196, such that the loudspeakers are perceived as being located behind the listener even if the actual position of the loudspeakers is to the side. The modified left surround and right surround signals appear at terminals 198 and 200, respectively. Additional details of this circuit will be presented in a later section.

Figure 3:
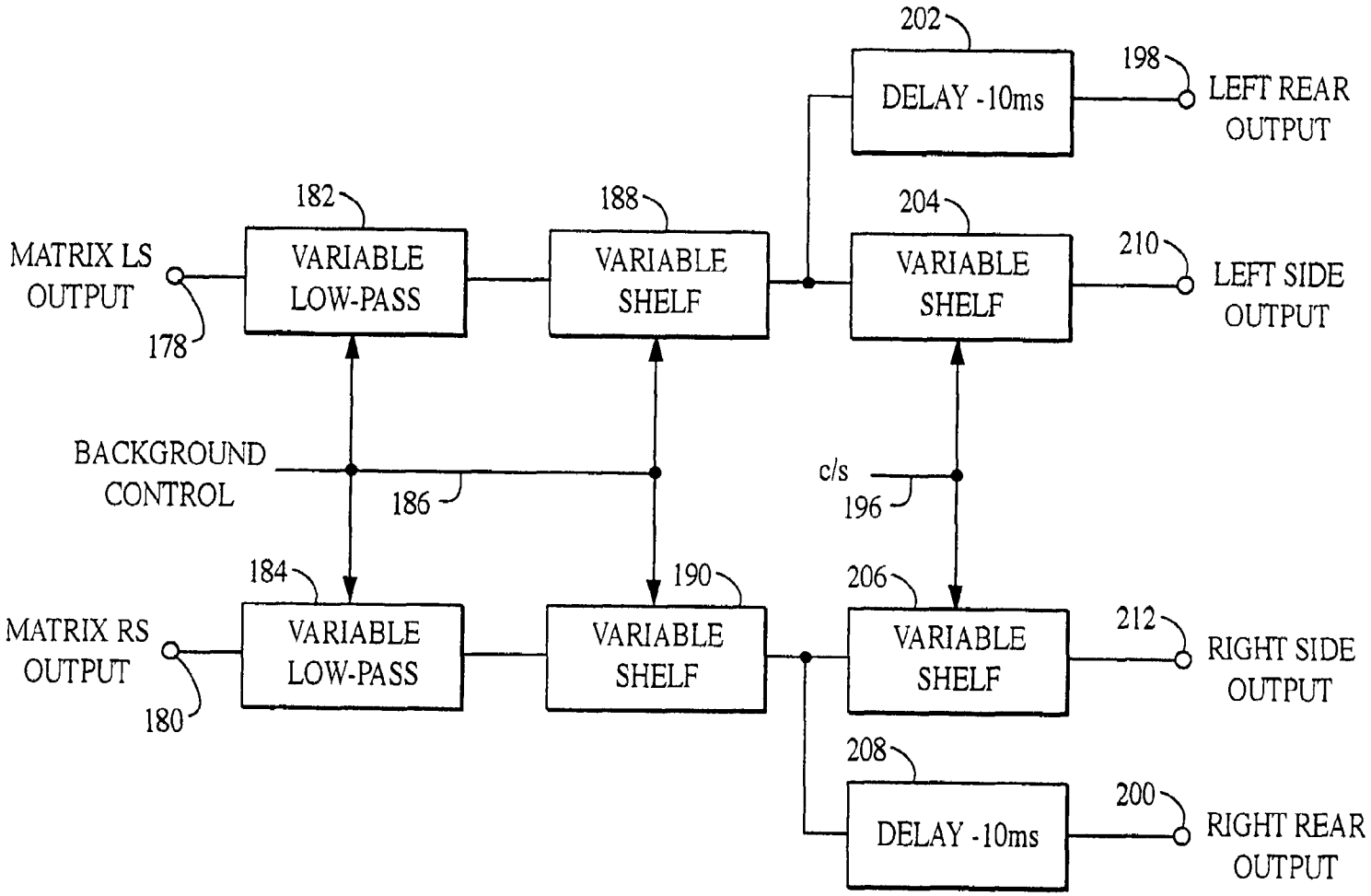
FIG. 3 is a block diagram of a five-to-seven channel frequency-dependent active signal processor, which may alternatively be connected between the outputs of the matrix section of FIG. 1 and the decoder outputs.

FIG. 3 shows the seven channel version of the frequency dependent elements. As before the first set of filters 182, 184, 188, and 190, attenuate the upper frequencies of the side and rear outputs when the steering is neutral or forward, and are controlled by the background control signal 186. This attenuation also results in a more forward sound image, and can be adjusted to the listener's taste. As the steering represented by the c/s signal 196 moves to the rear, additional circuits 202, 204, 206, and 208, act to differentiate the side outputs from the rear outputs. As steering moves rearward, the attenuation in the side speakers is removed by elements 204 and 206 to produce a side oriented sound. As steering moves further to the rear, the attenuation of elements 204 and 206 is reinstated and increased. This causes the sound to move smoothly from the front loudspeakers to the side loudspeaker(s) and then to the rear loudspeakers. However, the sound in the rear loudspeakers has a delay of about 10 ms, which is produced by the delay elements 202, and 208. Because the low frequencies are not affected by these circuits, the low frequency loudness in the side speakers (which is responsible for the perception of spaciousness) is not affected by the motion of the sound.

4. General Description of the Encoder

Figure 4:
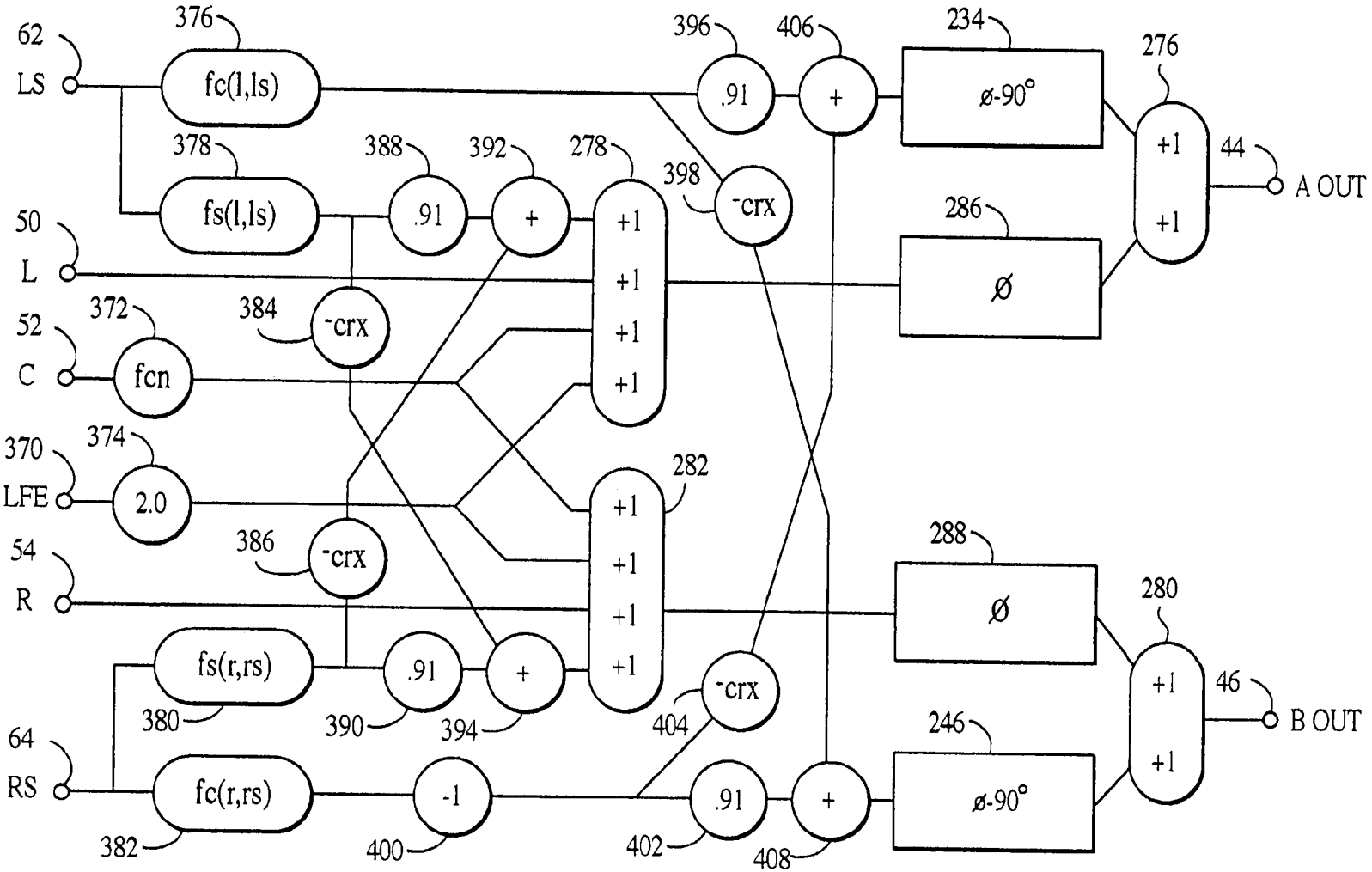
FIG. 4 is a block schematic of an active five-channel to two-channel encoder.

FIG. 4 shows a block diagram of an encoder designed to automatically mix five input channels into two output channels. The architecture is quite different from the encoder described in the November '96 application. An object of the encoder in FIG. 4 (the "new encoder") is to preserve the musical balance of the five channel original in the two output channels, while providing phase/amplitude cues that allow the original five channels to be extracted from the two output channels by a decoder. The new encoder includes active elements that ensure that the musical balance is preserved. Another object of the new encoder is to automatically create a two channel mix from a five channel recording that can be reproduced by an ordinary two channel system with the same artistic quality as the five channel original.

Unlike the encoder of the November '96 application, the new encoder allows input signals to be panned between any of the five inputs of the encoder. For example, a sound may be panned from the left front input to the right rear input. When the resulting two channel signal is decoded by the decoder described in this application, the result will be quite close to the original sound. Decoding through an earlier surround decoder will also be similar to the original.

In FIG. 4 the front input signals L, C and R are applied to input terminals 50, 52, and 54 respectively. L and R go directly to adders 278 and 282 respectively, while C is attenuated by a factor fcn in attenuator 372 before being applied to adders 278 and 282. A gain of 2.0 is applied to the low frequency effects signal LFE by element 374 before LFE is applied to adders 278 and 282.

The surround input signals LS and RS are applied to input terminals 62 and 64, respectively. The LS signal passes through attenuator 378, which has gain fs(l,ls), and the RS signal passes through attenuator 380, which has gain fs(r,rs). The outputs of these attenuators 378 and 380 are passed into cross-coupling elements 384 and 386, respectively, each having a gain factor of −crx, where crx is nominally 0.383. The cross-coupled signals from cross-coupled elements 386 and 384 are fed to summers 392 and 394, respectively, which also receive the attenuated LS and RS signals, respectively, from 0.91 attenuators 388 and 392, respectively. The outputs of summers 392 and 394, are applied to inputs of the adders 278 and 282, respectively. This positions the side elements at 45 degrees left and right, respectively, of center rear in the decoded space.

LS and RS also pass through attenuator 376, which has gain fc(l,ls), and attenuator 382, which has gain fc(r,rs), respectively, and then through a similar arrangement of cross-coupling elements 396, 398, 402, 404, 406, and 408. The summers 406 and 408 have outputs that position the left rear and right rear inputs at 45 degrees left and right, respectively, of center rear, as before. However, LS and RS also pass through phase shifter elements 234 and 246, respectively, while the left and right signals from adders 278 and 282, respectively, pass through phase shifter elements 286 and 288, respectively. Each of these phase shifter elements is an all-pass filter, where the phase response for elements 286 and 288 is $\phi(f)$, and for elements 234 and 246 is $\phi(f)-90°$. Calculation of the component values required in these filters is well known in the art. The phase shifter elements cause the outputs of summers 406 and 408 to lag the outputs of adders 278 and 282 by 90 degrees at all frequencies. The outputs of all-pass filters 234 and 286 are combined by summer 276 to produce the A (or left) output signal at terminal 44, while the outputs of all-pass filters 246 and 288 are combined by summer 280 to produce the B (or right) output signal at terminal 46.

The gain functions fs and fc are designed to allow strong surround signals to be presented in phase with the other sounds while weak surround signals pass through the 90 degree phase-shifted path to retain constant power for decorrelated "music" signals. The value of crx can also change and varies the angle from which the surround signals are heard.

5. Design Goals for the Decoder Active Matrix Elements

The goals of the current decoder include: having variable matrix values that reduce directionally encoded audio components in outputs that are not directly involved in reproducing them in the intended direction; enhancing directionally encoded audio components in the outputs that are directly involved in reproducing them in the intended direction to maintain constant total power for such signals; preserving high separation between the left and right channel components of non-directional signals, regardless of the steering signals; and maintaining the loudness (defined as the total audio power level of non-directional signals) at an effectively constant level, whether directionally encoded signals are present and regardless of their intended direction.

Most of these goals are ostensibly shared by all matrix decoders. One of the most important goals is explicitly maintaining high separation between the left and right channels of the decoder under all conditions. All previous four channel decoders are unable to maintain separation in the rear because they provide only a single rear channel. Five other channel decoders can maintain separation in many ways. The decoder described in this application meets this goal in a manner similar to that used by V1.11, and meets additional goals as well.

The November '96 application also describes many smaller improvements to a decoder, such as circuits to improve the steering signals' accuracy, and a variable phase shift network to switch the phase shift of one of the rear channels during strong rear steering. These features (included in V1.11) are retained in the current decoder.

6. Design Improvements Since the November '96 Application

One of the most noticeable improvements made to the decoder and encoder of the November '96 application is the change in the center matrix elements and the left and right front matrix elements when a signal is steered in the center direction. There were two problems with the center channel as previously encoded and decoded. The most obvious problem was that, in a five channel matrix system, the use of a center channel was inherently in conflict with the goal of maintaining as much left/right separation as possible. If the matrix is to produce a sensible output from conventional two channel stereo material when the two input channels have no left/right component, the center channel must be driven with the sum of the left and right input channels. Thus both the left decoder input and the right decoder input will be reproduced by the center speaker and sounds that were originally only in the left or right channel will also be reproduced from the center. This results in the apparent position of these sounds being drawn to the middle of the room. The degree to which this occurs depends on the loudness of the center channel.

The '89 patent and the '92 patent used center matrix elements that had a minimum value of 3 dB compared to the left and right channels. When the inputs to the decoder were decorrelated, the loudness of the center channel was equal to the loudness of the left and right channels. As steering moved forward, the center matrix elements increased another 3 dB, which strongly reduced the width of the front image. Instruments that should have sounded as if positioned to either the left or the right of the sound image are always drawn toward the center of the sound image.

The November '96 application used center matrix elements that had a minimum value 4.5 dB less than values previously used. This minimum value was chosen on the basis of listening tests and caused a pleasing spread to the front image when the input material was uncorrelated (which is the case with orchestral music). Therefore, the front image was not seriously narrowed. However, as the steering moved forward, these matrix elements were increased and ultimately reach the values used in the Dolby® matrix.

Experience with V1.11 showed that although the reduction in center channel loudness solved the spatial problem, the power balance in the input signals was not preserved through the matrix. Mathematical analysis revealed that not only was V1.11 in error with regard to the power balance, but the Dolby® decoder and other previous decoders were also in error. Paradoxically, although the center channel was too strong from the standpoint of reproducing the width of the front image, it was too weak to preserve power balance. The problem was particularly severe for the standard Dolby® decoder (the decoder of Mandel). In the standard Dolby® decoder, the rear channels are stronger than in the decoder of the '89 patent. As a result, the center channel must be stronger to preserve the power balance. The lack of power balance in the center channel has been a continual problem for the Dolby® decoder. In fact, Dolby® recommends that the sound mix engineer always listen to the balance through the matrix, so compensation can be made during the mixing process for the lack of power balance in the matrix during the mixing process. Unfortunately, modern films are mixed for five-channel release, and automatic encoding to two channels can lead to problems with the dialog level.

Additional analysis and listening tests showed that films and music require different solutions to the balance problem. For films, it is most useful to preserve the left and right front matrix elements from the November '96 application. These elements eliminate the center channel information from the left and right front channels as much as possible, which minimizes dialog leakage into the front left and right channels. In a new "film" design, the power balance is corrected by changing the center matrix elements so that the center channel loudness increases more rapidly than in the standard decoder as the steering moves forward (as cs becomes greater than zero.) In practice it is not necessary for the final value of the center matrix elements to be higher than those in the standard decoder, because this condition is reached when only the center channel is active. It is only necessary for the center channel level to be stronger than the standard decoder when there are approximately equal levels in the center, left and right channels.

In the "film" strategy, the center channel loudness is increased to preserve the power balance in the input signals, while minimizing the center channel component in all the other outputs. This strategy seems to be ideal for films, where the major use of the center channel is for dialog, and dialog from positions other than the center is not expected. The major disadvantage of this strategy is that anytime there is significant center steering, such as that which occurs in many types of popular music, the front image is narrowed. However, the advantages for film, which include minimum dialog leakage into the front channels and excellent power balance, outweigh this disadvantage.

For music another strategy is adopted, in which the center channel loudness is permitted to increase at the same rate described in the November '96 application, up to a middle value of the steering (where cs>22.5 degrees). To restore the musical balance, the left and right front matrix elements are altered so that the center component of the input signals is not entirely removed. The amount of the center channel component in the left and right front channels is adjusted so that the sound power from all the outputs of the decoder matches the sound power in the input signals, without excessive loudness in the center.

In this strategy, all three front speakers reproduce center channel information present in the original encoded material. The most useful version of this strategy limits the steering action when the center component of the input is 6 dB stronger in the center output than in either of the two other front outputs. This is done by simply limiting the positive value of cs.

This new strategy, which allows the center channel component to come from all three front speakers, and limits the steering action when the center is 6 dB louder than the front left and right, is excellent for all types of music. Encoded five-channel mixes and ordinary two-channel mixes are decoded with a stable center and adequate separation between the center channel and the left and right channels. Note that unlike previous decoders, the separation between center and left and right is deliberately not complete. A signal intended to come from the left is eliminated from the center channel, but not the other way around. For music, the high lateral separation and stable front image that this strategy offers outweighs this lack of complete separation. Listening tests using this setting on films reveal that although there was some dialog coming from the left and right front speakers, the stability of the resulting sound image was quite good. The resulting sound was pleasant and not distracting. Therefore, hearing a film with the decoder set for music does not detract from the artistic quality of the film. However, listening to a music recording with the decoder set for film is more problematic.

Possibly the next most obvious improvement made to the decoder and encoder of the November '96 application is the increase in separation between the front channels and the rear channels when a signal is steered to the left front or the left rear directions. V1.11 used the matrix elements of the '89 patent for the front channels under these conditions. These matrix elements did not fully eliminate a rear steered signal unless it was steered to the full rear position (which is the position half way between left rear and right rear). When steering was to left rear or right rear (not full rear), the left or right front output had an output that was 9 dB less than the corresponding rear output. In the present decoder the front matrix elements are modified to eliminate sound from the front when steering is anywhere between left rear and right rear.

7. Improvements to the Rear Matrix Elements

The improvements to the rear matrix elements are not immediately obvious to a typical listener. These improvements correct various errors in the continuity of the matrix elements across the boundaries between quadrants. They also improve the power balance between steered signals and unsteered signals under various conditions. A mathematical description of the matrix elements that includes these improvements will be given later in this document.

8. Detailed Description of the Active Matrix Elements

The Matlab Language

The math used to describe the matrix elements is not based on continuous functions of the variables cs and lr. In general there are conditionals, absolute values, and other non-linear modifications to the formulae. For this reason the matrix elements will be described using a programming language. The Matlab language provides a simple method of checking the formulation graphically. Matlab is very similar to Fortran or C. The major difference is that variables in Matlab can be vectors which means that each variable can represent an array of numbers in sequence. For example, the variable x can be defined according to an expression "x=1:10." Defining x in this manner in Matlab creates a string of ten numbers with the values of one to ten. The variable x includes all ten values and is described as a vector (which is a 1 by 10 matrix). An individual number within each vector can be accessed or manipulated. For example, the expression "x(4)=4" will set the fourth member of the vector x equal to 4. A variable can also represent a two dimensional matrix and individual elements in the matrix can be assigned in a similar way. For example, the expression "X(2,3)=10" will assign the value 10 to the matrix element in the second row and third column of the matrix X.

9. Matrix Decoders in Equations and Graphics

Reference [1] presented the design of a matrix decoder that can be described by the elements of a n×2 matrix, where n is the number of output channels. Each output can be seen as a linear combination of the two inputs, where the coefficients of the linear combination are given by the elements in the matrix. In this document the elements are identified by a simple combination of letters. Reference [1] described a five-channel and a seven-channel decoder. Because the conversion from five channels to seven channels can now be done in the frequency dependent part of the decoder, what follows is description of a five-channel decoder only.

Due to from symmetry the behavior of only six elements (such as the left elements) need to be described. These six elements include the center elements, the two left front elements, and the two left rear elements. The right elements can found from the left elements by simply switching the identity of left and right. The left elements are indicated by the following notation:

CL: The matrix element for the Left input channel to the Center output channel.

CR: The matrix element for the Right input channel to the Center output channel.

LFL: The Left input channel to the Left Front output channel.

LFR: The Right input channel to the Left Front output channel.

LRL: The Left input channel to the Left Rear output channel.

LRR: The Right input channel to the Left Rear output channel.

These elements are not constant. Their value varies as a two dimensional function of the apparent direction of the input sounds. Most phase/amplitude decoders determine the apparent direction of the input by comparing the ratio of the amplitudes of the input signals. For example, the degree of steering in the right/left direction is determined from the ratio of the left input channel amplitude to the right input channel amplitude. In a similar way, the degree of steering in the front/back direction is determined from the ratio of the amplitudes of the sum and the difference of the input channels.

In this document, the apparent directions of the input signals will be represented as angles, including one angle for the left/right direction (lr), and one for the front/back (also known as the center/surround) direction (cs). The two steering directions lr and cs are signed variables. When the two input channels are uncorrelated, both lr and cs are zero and the input signals are, therefore, unsteered. When the input consists of a single signal which has been directionally encoded, the two steering directions have their maximum value however, they are not independent. The advantage to representing the steering values as angles is that when there is only a single signal, the sum of the absolute value of each of the two steering values must equal 45 degrees. When the input includes some decorrelated material along with a strongly steered signal, the sum of the absolute values of each of the steering values must be less than 45 degrees as indicated by the following equation:

$$|lr|+|cs|<45 \tag{2}$$

If the values of the matrix elements are plotted over a two-dimensional plane formed by the steering values, the center of the plane will have the value (0, 0) and the valid values for the sum of the absolute values of the steering values will not exceed 45. In practice, it is possible for the sum to exceed 45, due to the behavior of non-linear filters.

To prevent this, a circuit that limits the lesser of lr or cs so their sum does not exceed 45 degrees may be used, such as the circuit described in the November '96 application. When the matrix elements are graphed the values will arbitrarily be set to zero when the valid sum of the input variables is exceeded. This allows the behavior of the element along the boundary trajectory (the trajectory followed by a strongly steered signal) to be viewed directly. The graphics were created using Matlab. In the Matlab language, the unsteered position is (46, 46) because Matlab requires the angle variable to be 1 more than the actual angle value.

Previous designs for matrix decoders tended to consider only the behavior of the matrix in response to a strongly steered signal, which is the behavior of the matrix elements around the boundary of the surface formed by plotting the matrix elements over a two-dimensional plane defined by the steering values. This is a fundamental error in outlook because, in real signals (for example, those found in either film or music), the boundary of the surface is very seldom reached. For the most part, signals wobble around the middle of the plane, which is slightly forward of the center. The behavior of the matrix under these conditions is of vital importance to the sound. When the elements described in this document are compared to previous elements, a striking increase in the complexity of the surface in the middle regions can be seen. It is this complexity which is responsible for the improvement in the sound.

However, such complexity has a price. The elements described in this document are designed to be almost entirely described by one-dimensional lookup tables, which are trivial in a digital implementation. However, unlike the matrix of the '89 patent, designing an analog version with similar performance is not trivial.

In the sections that follow, several different versions of the matrix elements are contrasted. The earliest are elements from the '89 patent. These elements are identical to the elements of a standard (Dolby®) surround processor in the left, center, and right channels, but not in the surround channels. In the design of the '89 patent, the surround channel is treated symmetrically to the center channel. In the standard (Dolby®) decoder, the surround channel is treated differently.

The elements presented are not always correctly scaled. In general they are presented so that the unsteered value of the non-zero matrix elements for any given channel is one. In practice, the elements are usually scaled so that the maximum value of each element is one or lower. In any case, the scaling of the elements is additionally varied in the calibration procedure. It may be assumed that the matrix elements presented in this document are scalable by the appropriate constants.

10. The Left Front Matrix Elements in Our '89 Patent

Assume that cs and lr are the steering directions in degrees in the center/surround and left/right axis respectively. In the '89 patent, the equations for the front matrix elements are defined according to equations (3a), (3b), (3c), (3d), (3e), (3f), (3g), and (3h). In the left front quadrant:

$$LFL=1-0.5*G(cs)+0.41*G(lr) \quad (3a)$$

$$LFR=-0.5*G(cs) \quad (3b)$$

In the right front quadrant:

$$LFL=1-0.5*G(cs) \quad (3c)$$

$$LFR=-0.5*G(cs) \quad (3d)$$

In the left rear quadrant (cs is negative):

$$LFL=1-0.5*G(cs)+0.41*G(lr) \quad (3e)$$

$$LFR=-0.5*G(cs) \quad (3f)$$

In the right rear quadrant:

$$LFL=1-0.5*G(cs) \quad (3g)$$

$$LFR=-0.5*G(cs) \quad (3h)$$

Figure 5:
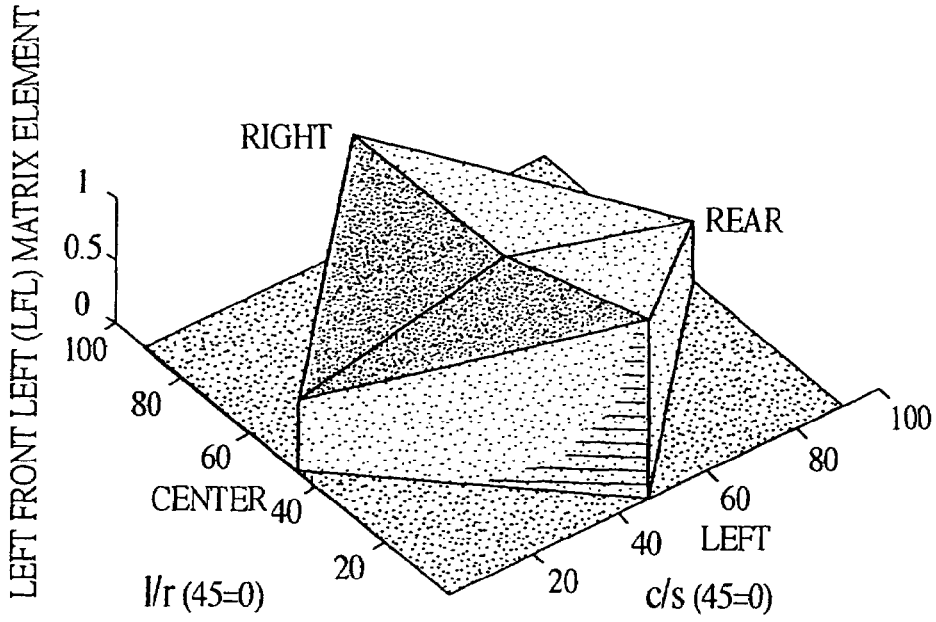
FIG. 5 is a three-dimensional graph of a Left Front Left (LFL) matrix element from the '89 patent and Dolby® Pro-logic® scaled so that the maximum value is one.
Figure 6:
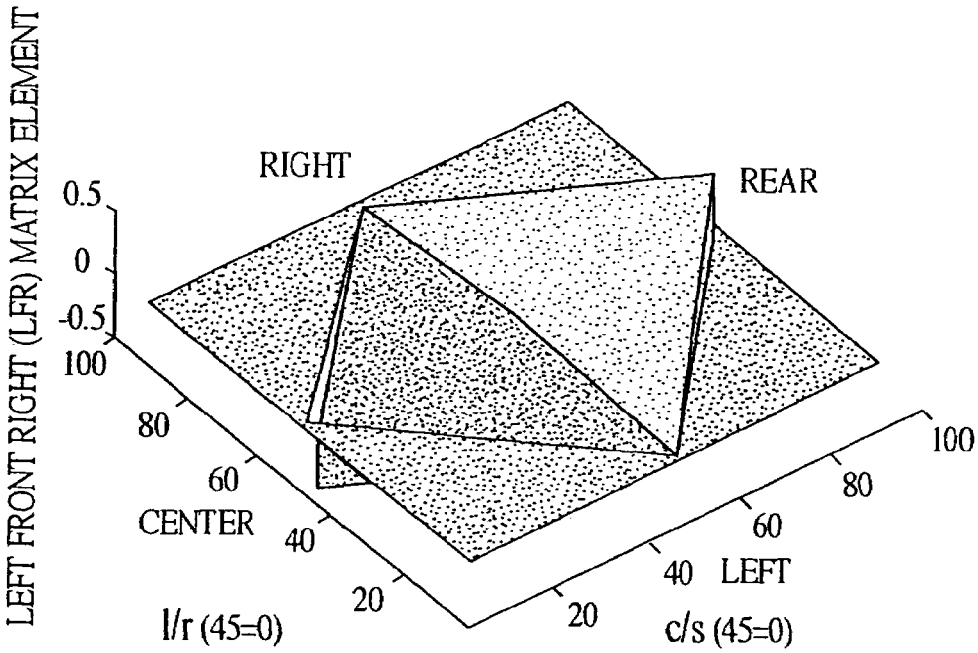
FIG. 6 is a three-dimensional graph of a Left Front Right (LFR) matrix element from the '89 patent and Dolby® Pro-Logic® scaled by 0.71 so that the minimum value is −0.5 and the maximum value is +0.5.

The function G(x) was determined experimentally in the '89 patent and was specified mathematically in the '92 patent. G(x) varies from 0 to 1 as x varies from 0 to 45 degrees. When steering is in the left front quadrant (lr and cs are both positive), G(x) is equal to $1-|r|/|l|$ where $|r|$ and $|l|$ are the right and left input amplitudes. G(x) can also be described in terms of the steering angles using various formulae. One of these is given in the '92 patent, and another will be given later in this document. Graphical representations of the LFL and LFR matrix elements plotted three dimensionally against the lr and cs axes are shown in FIG. 5 and FIG. 6.

Figure 7:
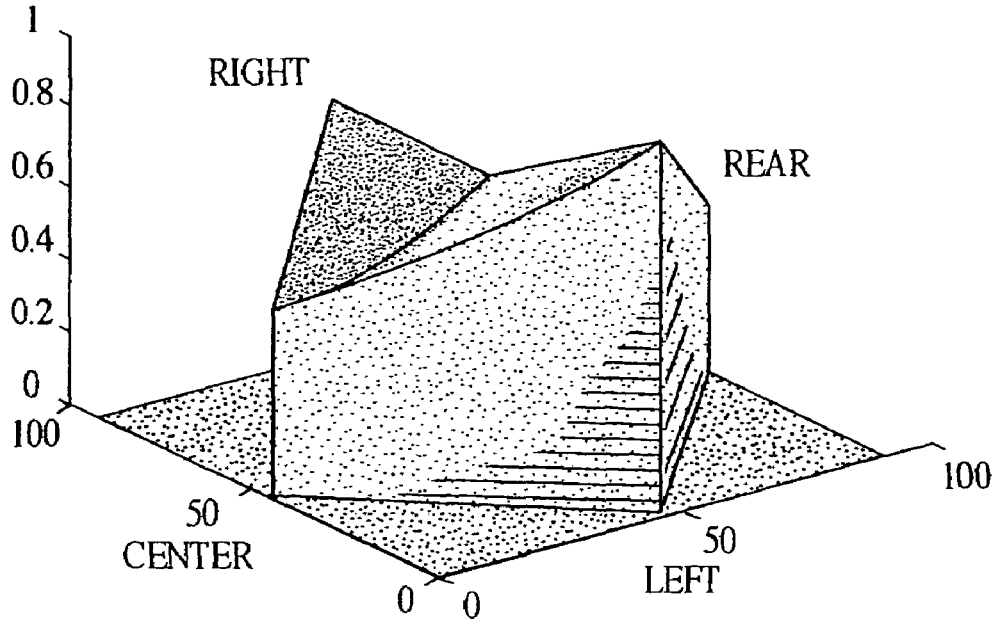
FIG. 7 is a three-dimensional graph of the square root of the sum of the squares of LFL and LFR matrix elements from the '89 patent scaled so that the maximum value is one.

In reference [1], these elements were improved by adding a requirement that the loudness of unsteered material should be constant regardless of the direction of the steering. Mathematically this means that the root mean square sum of the LFL and LFR matrix elements should be a constant. This goal should be altered in the direction of the steering, which means that when the steering is full left, the sum of the squares of these matrix elements should rise by 3 dB. FIG. 7 shows the sum of the squares of these elements and demonstrates that the above matrix elements do not meet the requirement of constant loudness. In FIG. 7, the value is constant at 0.71 along the axis from unsteered to right. The value along the axis from unsteered to left rises 3 dB to one, and the value along the axis from unsteered to center or from unsteered to rear falls 3 dB to 0.5. The value along the axis from unsteered to rear is hidden by the peak at left. The rear direction level is identical to that at the center direction.

Figure 8:
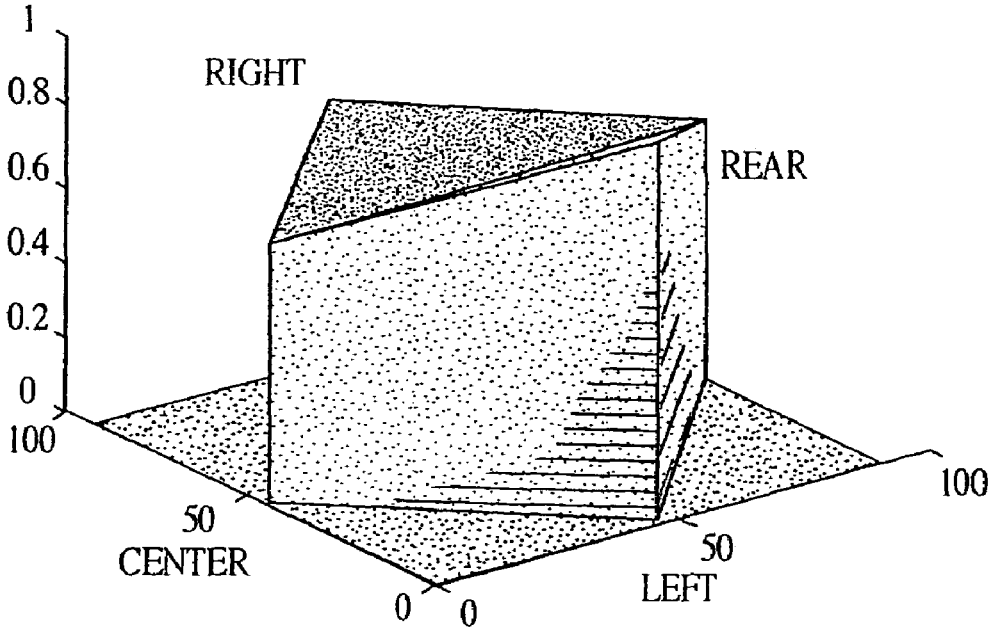
FIG. 8 is a three-dimensional graph of the square root of the sum of the LFL and LFR matrix elements from the November '96 application No. scaled so that the maximum value is 1.

In the November '96 application and Reference [1], the amplitude errors in FIG. 7 were corrected by replacing the function G(x) in the matrix equations with sines and cosines: FIG. 8 shows a graph of the sum of the squares of the corrected elements LFL and LFR, which are described by the equations (4a)-(4h) below. Note the constant value of 0.71 in the entire right half of the plane, and the gentle rise to one toward the left vertex. For the left front quadrant:

$$LFL=\cos(cs)+0.41*G(lr) \quad (4a)$$

$$LFR=-\sin(cs) \quad (4b)$$

For the right front quadrant:

$$LFL=\cos(cs) \quad (4c)$$

$$LFR=-\sin(cs) \quad (4d)$$

For the left rear quadrant:

$$LFL=\cos(-cs)+0.41*G(lr) \quad (4e)$$

$$LFR=\sin(-cs) \quad (4f)$$

For the right rear quadrant:

$$LFL=\cos(-cs) \quad (4g)$$

$$LFR=\sin(-cs) \quad (4h)$$

11. Improvements to the Left Front Matrix Elements

To improve the performance of the matrix elements with stereo music that was panned forward and to increase the separation between the front channels and the rear channels when stereo music was panned to the rear, an additional boost along the cs axis was added in the front, and a cut along the cs axis was added in the rear, respectively (the "March '97 version"). However, the basic functional dependence among these matrix elements was maintained. For the front left quadrant:

$$LFL=(\cos(cs)+0.41*G(lr))*\text{boost1}(cs) \quad (5a)$$

$$LFR=(-\sin(cs))*\text{boost1}(cs) \quad (5b)$$

For the right front quadrant:

$$LFL=(\cos(cs))*\text{boost1}(cs) \quad (5c)$$

$$LFR=(-\sin(cs))*\text{boost1}(cs) \quad (5d)$$

For the left rear quadrant:

$$LFL=(\cos(-cs)+0.41*G(lr))/\text{boost}(cs) \quad (5e)$$

$$LFR=(\sin(cs))/\text{boost}(cs) \quad (5f)$$

For the right rear quadrant:

$$LFL=(\cos(cs))/\text{boost}(cs) \quad (5g)$$

$$LFR=(\sin(cs))/\text{boost}(cs) \quad (5h)$$

where the function G(x) is the same as the one in the '89 patent. When expressed with angles as an input, G(x) is equal to:

$$G(x)=1-\tan(45-x) \quad (6)$$

In the March '97 circuit, the function boost1(cs) was a linear boost of 3 dB that was applied over the first 22.5 degrees of steering and was decreased back to 0 dB in the next 22.5 degrees of steering. Boost(cs) is given by corr(x) in the Matlab code below, in which comment lines are preceded by the percent symbol %:

```
% calculate a boost function of +3dB at 22.5 degrees
% corr(x) goes up 3dB and stays up. corr1(x) goes up then down again
for x = 1:24; % x has values of 1 to 24 representing 0 to 23 degrees
    corr(x) = 10^(3*(x-1)/(23*20)); % go up 3dB over this range
    corr1(x) = corr(x);
end
for x = 25:46 % go back down for corr1 over this range 24 to 45 degrees
    corr(x) = 1.41;
    corr1(x) = corr(48-x);
end
```

Figure 9:
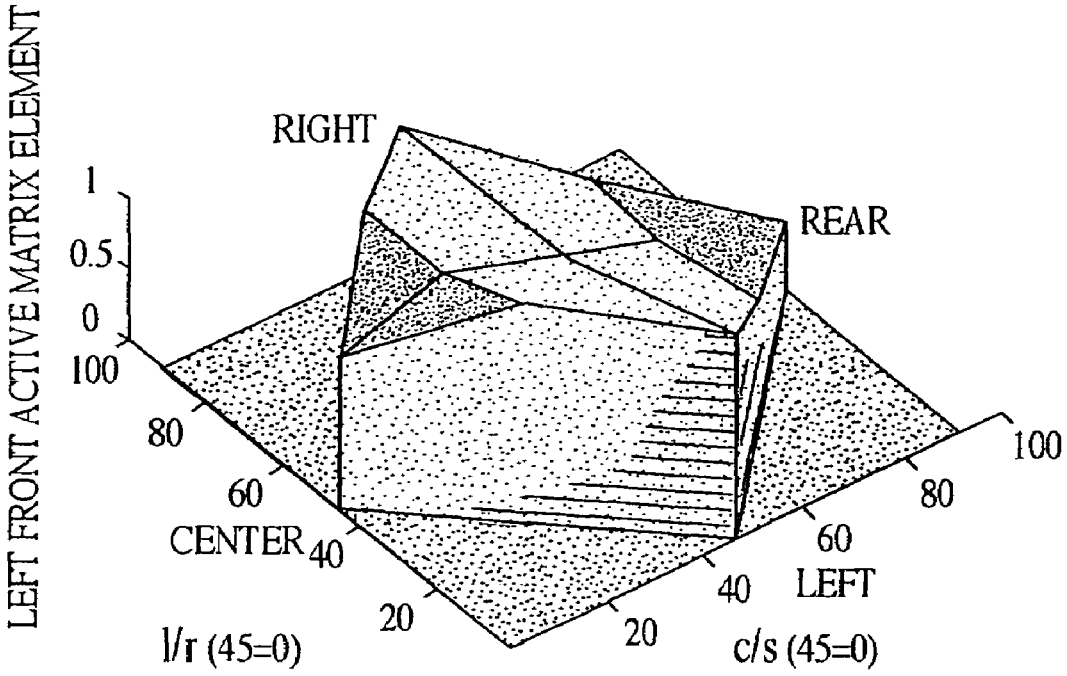
FIG. 9 is a three-dimensional graph of the LFL matrix element from V1.11.

FIG. 9 shows a plot of LFL resulting from equations (5a)-(5h). Note that as the steering moves toward center, the boost is applied both along the lr=0 axis, and along the left to center boundary. Note also the reduction in level as the steering moves to the rear.

The performance of the March '97 circuit can be improved. The first problem with the March '97 version is in the behavior of the steering along the boundaries between left and center, and between right and center. As shown in FIG. 9, the value of the LFL matrix element increases to a maximum half-way between left and center as a strong single signal pans from the left to the center. This increase is an unintended consequence of the deliberate increase in level for the left and right main outputs as a center signal is added to stereo music.

When a stereo signal is panned forward, it is desirable for the levels of the left and right front outputs to rise to compensate for the removal of the correlated component from these outputs by the matrix. However, this level increase should only occur when the lr component of the inputs is minimal (when there is no net left or right steering). Therefore, the boost is only needed along their lr=0 axis. When lr is non-zero, the matrix element should not be boosted.

The increase implemented in the March of '97 circuit was independent of lr, and therefore resulted in a level increase when a strong signal was panned across the boundary. This problem can be solved by using an additive term to the matrix elements, instead of a multiply. A new steering index (the boundary limited cs value) is defined with the following Matlab code:

```
Assume both lr and cs > 0 - we are in the left front quadrant
(assume cs and lr follow the Matlab conventions of varying from 1
to = 46) % find the bounded c/s
    if(cs < 24)
        bcs = cs-(lr-1);
        if(bcs< 1) % this limits the maximum value
            bcs = 1;
        end
    else
        bcs = 47-cs-(lr-1);
        if(bcs < 1)
            bcs = 1;
        end
    end
```

If cs<22.5 and lr=0, (in the Matlab convention cs<24 and lr=1) bcs is equal to cs. However, bcs will decrease to zero as lr increases. If cs>22.5, bcs also decreases as lr increases.

To find the correction function needed, the difference between the boosted matrix elements and the non-boosted matrix elements are found along the lr=0 axis. This difference is called cos_tbl_plus and sin_tbl_plus. Using Matlab code:

```
a=0:45; % define a vector in one degree steps. a has the
    values of 0 to 45 degrees
a1=2*pi*a/360: % convert to radians
% now define the sine and cosine tables, as well as the
    boost tables for the front
sin_tbl=sin(a1);
cos_tbl=cos(a1);
cos_tbl_plus=cos(a1).*corr1(a+1);
cos_tbl_plus=cos tbl_plus-cos_tbl; % this is the one we
    use
cos_tbl_minus=cos(a1)./corr(a+1);
sin_tbl_plus=sin(a1).*corr1(a+1);
sin_tbl_plus=sin tbl_plus-sin_tbl; % this is the one we
    use
sin_tbl_minus=sin(a1)./corr(a+1);
```

The vectors sin_tbl_plus and cos_tbl_plus are the difference between a plain sine and cosine, and the boosted sine and cosine. LFL and LFR are defined according to the following equations:

$$LFL=\cos(cs)+0.41*G(lr)+\cos_tbl_\text{plus}(bcs) \quad (7a)$$

$$LFR=-\sin(cs)-\sin_tbl_\text{plus}(bcs) \quad (7b)$$

Figure 10:
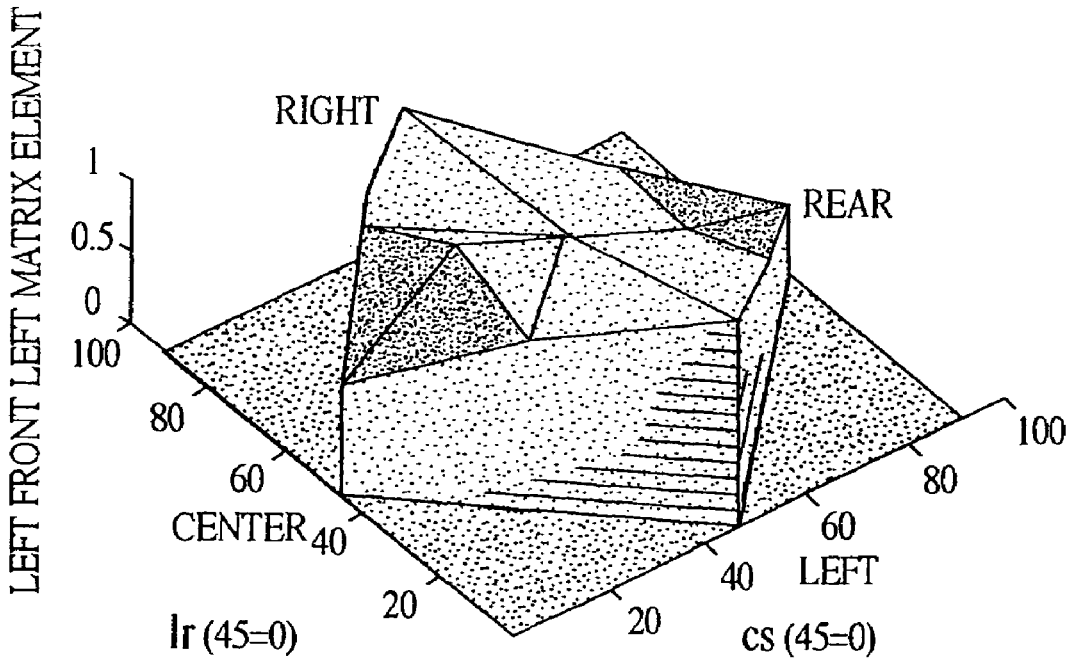
FIG. 10 is a three-dimensional graph of a partially completed LFL matrix element.

In the front right quadrant LFL and LFR are similar, but do not include the +0.41*G term. These new definitions lead to the matrix element shown graphically in FIG. 10. In FIG. 10, the new element has the correct amplitude along the left to center boundary, as well as along the center to right boundary.

The steering in the rear quadrant is not optimal either. When the steering is toward the rear, the above matrix elements are given by:

$$LFL=\cos_tbl_\text{minus}(-cs)+0.41*G(-cs) \tag{8a}$$

$$LFR=\sin_tbl_\text{minus}(-cs) \tag{8b}$$

These matrix elements are very nearly identical to the elements in the '89 patent. Consider the case when a strong signal pans from left to rear. The elements in the '89 patent were designed so that there was a complete cancellation of the output from the front left output only when this signal is fully to the rear (cs=−45. lr=0). However, it is desirable for the left front output to be zero when the encoded signal reaches the left rear direction (cs=−22.5 and lr=22.5), and for the left front output to remain at zero as the signal pans further to full rear. The matrix elements used in March '97 circuit result in the output in the front left channel being about −9 dB when a signal is panned to the left rear position. This level difference is sufficient for good performance of the matrix, but it is not as good as it could be.

Performance can be improved by altering the LFL and LFR matrix elements in the left rear quadrant. The concern here is how the matrix elements vary along the boundary between left and rear. The mathematical method given in reference [1] can be used to find the behavior of the elements along the boundary. If it is assumed that the amplitude of the left front output should decrease with the function F(t) as t varies from 0 degrees (left) to minus 22.5 degrees (left rear), the matrix elements are defined according to the following equations:

$$LFL=\cos(t)*F(t)-/+\sin(t)*(\text{sqrt}(1-F(t)\hat{}2)) \tag{9a}$$

$$LFR=(\sin(t)*F(t)+/-\cos(t)*(\text{sqrt}(1-F(t)\hat{}2))) \tag{9b}$$

If F(t)=cos(4*t) and the correct sign is chosen, equations (9a) and (9b) simplify to the following equations:

$$LFL=\cos(t)*\cos(4*t)+\sin(t)*\sin(4*t) \tag{9c}$$

$$LFR=(\sin(t)*\cos(4*t)-\cos(t)*\sin(4*t) \tag{9d}$$

Figure 11:
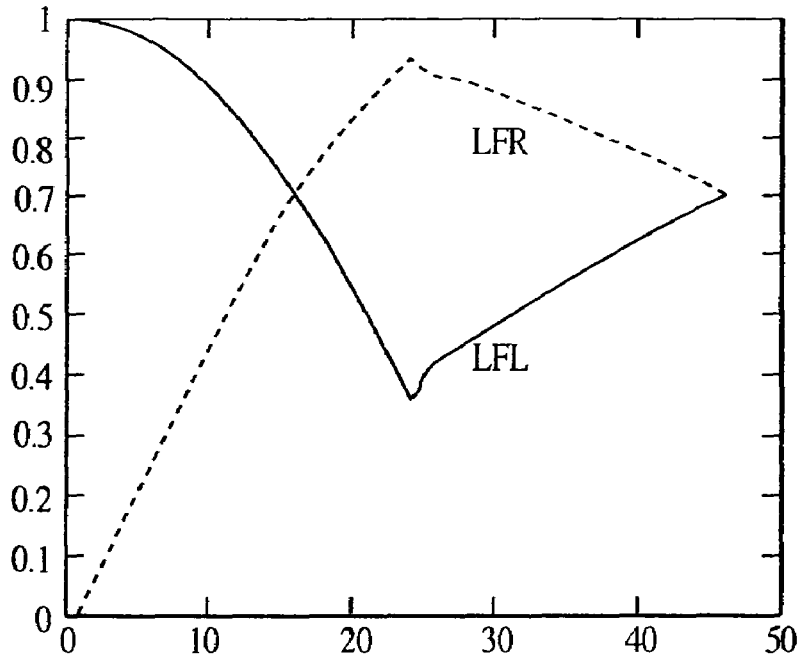
FIG. 11 is a graph showing the behavior of the LFL and LFR matrix elements along the rear boundary between left and full rear.

A plot of these coefficients is shown in FIG. 11, where LFL (solid curve) and LFR (dotted curve) are plotted as a function of t. Because all angles in Matlab are integers, the slight glitch in the middle is due to the absence of a point at 22.5 degrees.

These elements work well. As shown in FIG. 11, the front left output is reduced smoothly to zero as t varies from 0 to 22.5 degrees. However, it is desirable for the output to remain at zero as the steering continues from 22.5 degrees to 45 degrees (full rear.) Along this part of the boundary, LFL and LFR are defined according to the following equations:

$$LFL=-\sin(t) \tag{10a}$$

$$LFR=\cos(t) \tag{10b}$$

These matrix elements are a far cry from the matrix elements along the lr=0 boundary where, in reference [1], the values were defined according to the following equations:

$$LFL=\cos(cs) \tag{10c}$$

$$LFR=\sin(cs) \tag{10d}$$

These matrix elements are designed to behave properly with a strongly steered signal (where both cs and lr have maximum values). The previous matrix elements were successful for signals where lr is near zero (stereo signals that have been panned to the rear). Therefore, a method of smoothly transforming the earlier matrix elements into the newer matrix elements as lr and cs approach the boundary is needed. One may include approach linear interpolation. Another approach, which is particularly useful where multiplies are expensive, includes defining the minimum of lr and cs as a new variable. One example of this approach is shown in the Matlab segment below:

```
% new - find the boundary parameter
    bp=x;
    if(bp > y)
        bp = y;
    end
```

and a new correction function which depends on bp:

```
for x =1:24
    ax = 2*pi* (46-x), 360;
    front_boundary_tbl(x) = (cos(ax)-sin(ax))/(cos(ax)+sin(ax));
end
for x=25:46
    ax = 2*pi*(x-1)/360;
    front_boundary_tbl(x) = (cos(ax)-sin(ax))/(cos(ax)+sin(ax));
end
```

LFL and LFR are then defined in this quadrant according to the following equations:

$$LFL=\cos(cs)/(\cos(cs)+\sin(cs))-\text{front_boundary_tbl}(bp)+0.41*G(lr) \tag{11a}$$

$$LFR=\sin(cs)/(\cos(cs)+\sin(cs))+\text{front_boundary_tbl}(bp) \tag{11b}$$

Note the correction of cos(cs)+sin(cs). When cos(cs) is divided by this factor, the function 1−0.5*G(cs) is obtained, which is the same as the Dolby® matrix in this quadrant. Then sin(cs) is divided by this factor and the earlier function +0.5*G(cs) is obtained.

Similarly in the right rear quadrant, LFL and LFR are defined according to the following equations:

$$LFL=\cos(cs)/(\cos(cs)+\sin(cs))=1-0.5*G(cs). \tag{12a}$$

$$LFR=\sin(cs)/(\cos(cs)+\sin(cs))=0.5*G(cs) \tag{12b}$$

Figure 12:
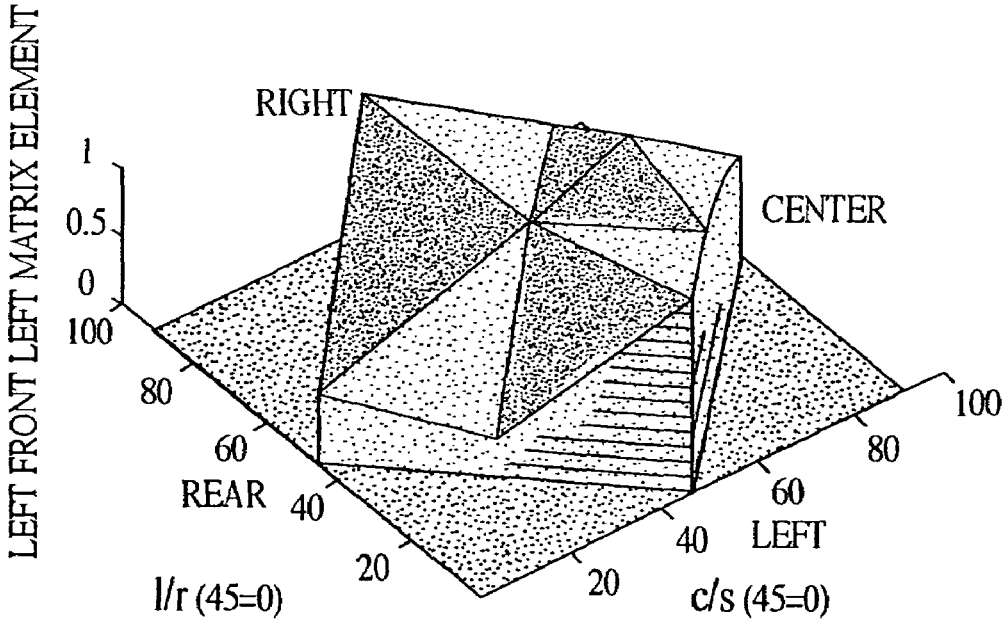
FIG. 12 is a three-dimensional graph of the fully completed LFL matrix element as viewed from the left rear.
Figure 13:
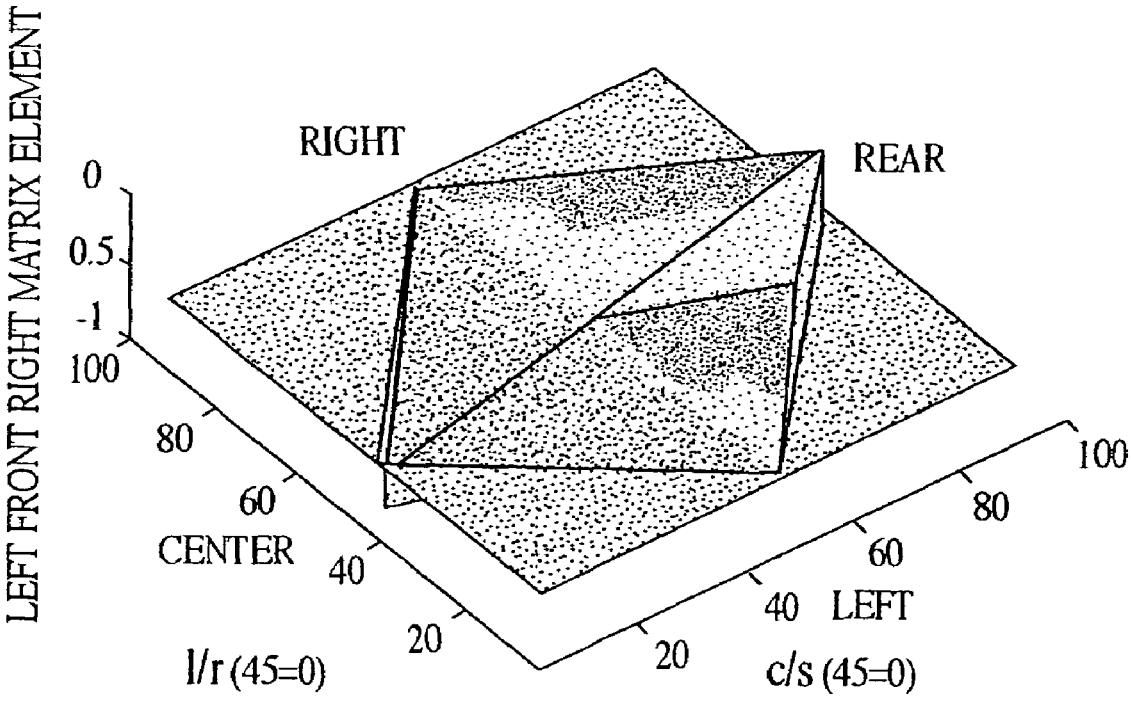
FIG. 13 is a three-dimensional graph of the fully completed LFR matrix element.

A graphical display of LFL and LFR is shown in FIG. 12 and FIG. 13, respectively.

In FIG. 12, which presents the left rear of the coefficient graph, there is a large correction along the left-rear boundary. This large correction causes the front left output to go to zero when steering goes from left to left rear. The output remains zero as the steering progresses to full rear. The function is identical to the Dolby® matrix along the lr=0 axis and in the right rear quadrant.

In FIG. 13 there is a large peak in the left to rear boundary. This works in conjunction with the LFL matrix element to keep the front output at zero along this boundary as steering goes from left rear to full rear. Once again, the element is identical to the Dolby® matrix in the rear direction along the lr=0 axis and the rear right quadrant.

One of the major design goals for the matrix is that in any given output, the loudness of unsteered material presented to the inputs of the decoder should be constant, regardless of the direction of a steered signal present at the same time. As explained previously, this means that the sum of the squares of the matrix elements for each output should be one, regardless of the steering direction. However, as explained before, this requirement must be altered when there is strong steering in the direction of the output in question. That is, if with regard to the left front output, the sum of the squares of the matrix elements must increase by 3dB when the steering goes full left. The above elements also alter the requirement somewhat when the steering moves forward and backward along the lr=0 axis.

Figure 14:
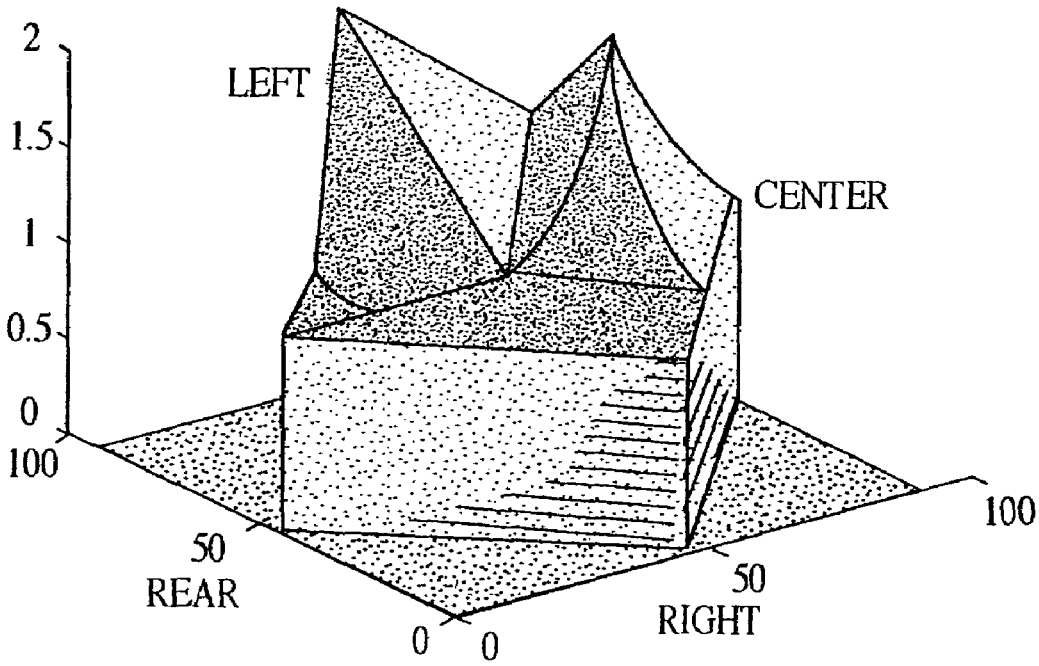
FIG. 14 is a three-dimensional graph of the root mean squared sum of the LFL and LFR matrix elements.
Figure 15:
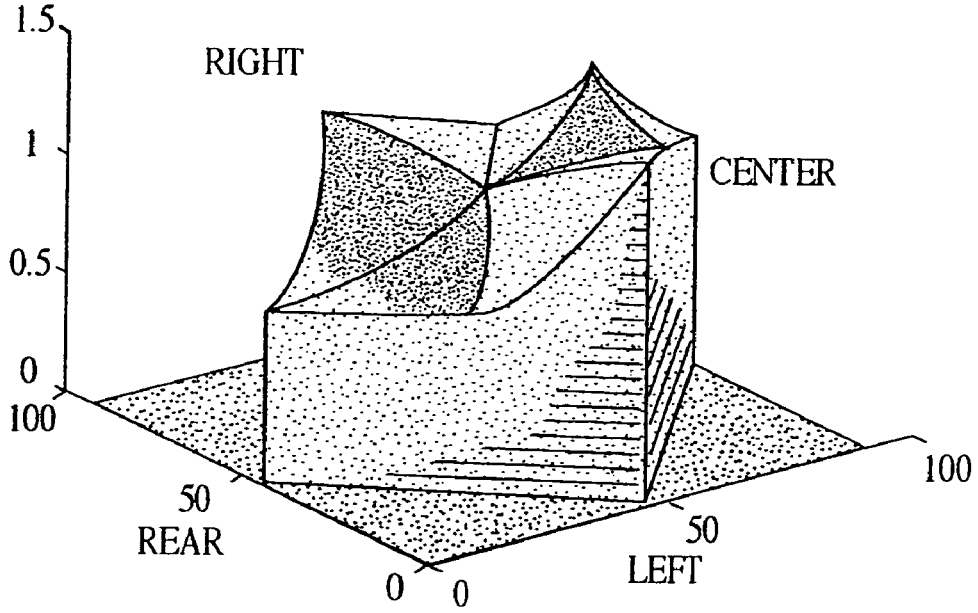
FIG. 15 is a three-dimensional graph of the square root of the sum of the squares of the LFL and LFR matrix elements, including the correction to the rear level, viewed from the left rear.

FIG. 14 and FIG. 15 show plots of the square root of the sum of the squares of the matrix elements for the revised design. In FIG. 14, the 1/(sin(cs)+cos(cs)) correction in the rear quadrant was deleted so that the accuracy of the resulting sum could be better visualized. In FIG. 15, there is a 3 dB peak in the left direction, and a somewhat lesser peak as a signal goes from unsteered to 22.5 degrees in the center direction. This peak is a result of the deliberate boost of the left and right outputs during half-front steering. Note that in the other quadrants the rms sum is very close to one, which was the intent of the design. Because the method used to produce the elements was an approximation, the value in the rear left quadrant is not quite equal to one. However, it is a pretty good match.

In FIG. 15, the unsteered (middle) to right axis has the value one, the center vertex has the value 0.71, the rear vertex has the value 0.5, and the left vertex has the value 1.41. Note that there is a peak along the middle to center axis.

12. Rear Matrix Elements During Front Steering

The rear matrix elements in the '89 patent, to which a scaling by 0.71 has been introduced to show the effect of the standard calibration procedure, are defined according to equations (13a), (13b), (13a) and (13c). For the front left quadrant:

$$LRL=0.71*(1-G(lr)) \tag{13a}$$

$$LRR=0.71*(-1) \tag{13b}$$

For the rear left quadrant:

$$LRL=0.71*(1-G(lr)+0.41*G(-cs)) \tag{13c}$$

$$LRR=-0.71*(1+0.41*G(-cs)) \tag{13d}$$

(the right half of the plane is identical but switches LRL and LRR.)

After a similar calibration, the rear matrix elements in the Dolby® Pro-Logic® are defined according to equations (14a), (14b), (14c), and (14d). For the front left quadrant:

$$LRL=1-G(lr) \tag{14a}$$

$$LRR=-1 \tag{14b}$$

For the rear left:

$$LRL=1-G(lr) \tag{14c}$$

$$LRR=-1 \tag{14d}$$

The right half of the plane is identical, but switches LRL and LRR. Note that the Dolby elements and the elements of the '89 patent are calibrated to be equal in the rear left quadrant when cs=−45 degrees.

13. A Brief Digression on the Surround Level in Dolby® Pro-Logic®

The Dolby® elements are similar to the elements given in the '89 patent, except that the boost is not dependent on cs in the rear. This difference is quite important, because after the standard calibration procedure, the elements have quite different values for unsteered signals. In general, the description in this document of the matrix elements does not consider the calibration procedure for these decoders and all the matrix elements are derived with a relatively arbitrary scaling. In most cases, the elements are presented as if they had a maximum value of 1.41. In fact, for technical reasons, the matrix elements are all eventually scaled so they have a maximum value of less than one. In addition, when the decoder is finally put to use, the gain of each output to the loudspeaker is adjusted. To adjust the gain of each output, a signal which has been encoded from the four major directions (left, center, right, and surround) with equal sound power is played, and the gain of each output is adjusted until the sound power is equal in the listening position. In practice, this means that the actual level of the matrix elements is scaled so the four outputs of the decoder are equal under conditions of full steering. This calibration has been explicitly included in the equations for the rear elements above.

The 3 dB difference in the elements in the forward steered or unsteered condition is not trivial. During unsteered conditions, the elements from the '89 patent have the value 0.71, and the sum of the squares of the elements has the value of one. This is not true of the calibrated Dolby® rear elements. LRL has the unsteered value of one, and the sum of the squares is 2, which is 3 dB higher than the outputs in the '89 patent. Note that the calibration procedure results in a matrix that does not correspond to the "Dolby® Surround®" passive matrix when the matrix is unsteered. The Dolby® Surround® passive matrix specifies that the rear output should have the value of $0.71*(A_{in}-B_{in})$, and the Dolby® Pro-Logic® matrix does not meet this specification. As a result, the rear output will be 3 dB stronger than the others when the A and B inputs are decorrelated. If there are two speakers sharing the rear output, each will be adjusted to be 3 dB softer than a single rear speaker, which will make all five speakers have approximately equal sound power when the decoder inputs are uncorrelated. When the matrix elements from the '89 patent are used, the same calibration procedure results in 3 dB less sound power from the rear when the decoder inputs are uncorrelated.

The issue of how loud the rear channels should be when the inputs are decorrelated is a matter of taste. When a surround encoded recording is being played, it may be desirable to reproduce the balance heard by the producer when the recording was mixed. Achieving this balance is a design goal for the decoder and encoder as a combination. However, with standard stereo material, the goal is to reproduce the power balance in the original recording, while generating a tasteful and unobtrusive surround. The problem with the Dolby® matrix elements is that the power balance in a conventional two channel recording is not preserved through the matrix, in that the surround channels are too strong, and the center channel is too weak.

To see the importance of this issue, consider what happens when the input to the decoder consists of three components, an uncorrelated left and right component, and a separate and uncorrelated center component.

$$A_{in}=L_{in}-0.71*C_{in} \tag{15a}$$

$$B_{in}=R_{in}+0.71*C_{in} \tag{15b}$$

When $A_{in}$ and $B_{in}$ are played through a conventional stereo system, the sound power in the room will be proportional to $L_{in}^2+R_{in}^2+C_{in}^2$. If all three components have roughly equal amplitudes, the power ratio of the center component to the left plus right component will be 1:2.

It may be desirable for the decoder to reproduce sound power in the room with approximately the same power ratio as stereo, regardless of the power ratio of $C_{in}$ to $L_{in}$ and $R_{in}$. This can be expressed mathematically. Essentially, the equal power ratio requirement will specify the functional form of the center matrix elements along the cs axis, if all the other matrix elements are taken as given. If it is assumed that the Dolby® matrix elements, calibrated such that the rear sound power is 3 dB less than the other three outputs when the matrix is fully steered (i.e. 3 dB less than the standard calibration), then the center matrix elements should have the shape shown in FIG. 16. If the same thing is done for the standard calibration, the results in FIG. 17 emerge.

Figure 16:
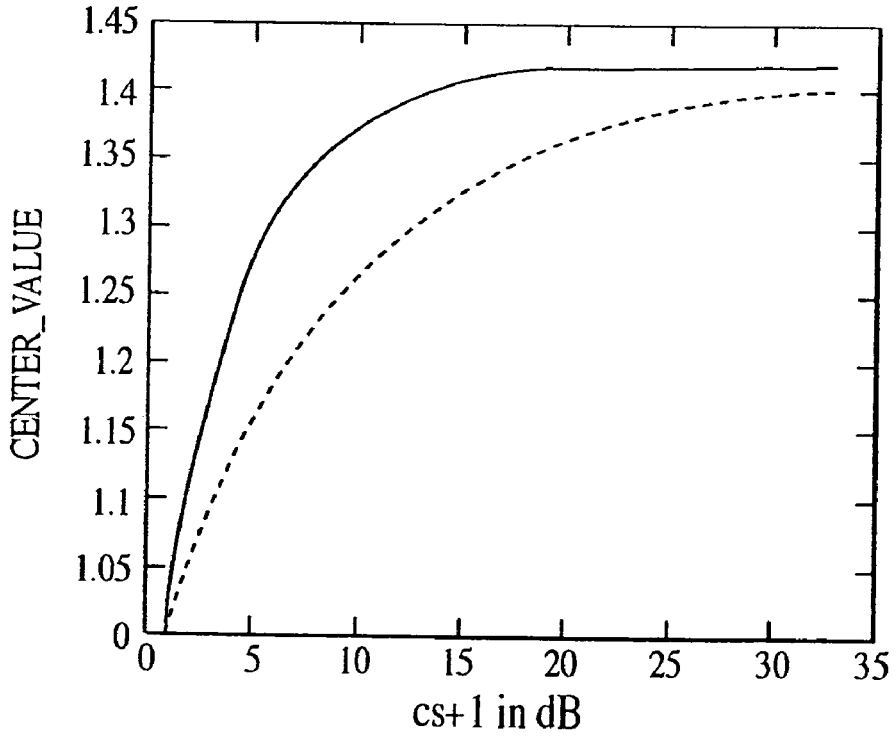
FIG. 16 is a graph showing the values of the center matrix elements that should be used in a Dolby® Pro-Logic® decoder as a function of cs in dB (the solid curve), and the actual values of the center matrix elements used in the Dolby® Pro-Logic® decoder (the dotted curve)

In FIG. 16, the solid curve shows the values of the center matrix elements as a function of cs assuming the power ratios in the decoder outputs are identical to the power ratios in stereo, and using the rear Dolby® matrix elements calibrated 3 dB lower in level than is typically used. The dotted curve shows the actual value of the center matrix elements in Pro-Logic®. While the actual value gives reasonable results for an unsteered signal and a fully steered signal, the actual value is about 1.5 dB too low in the middle.

Figure 17:
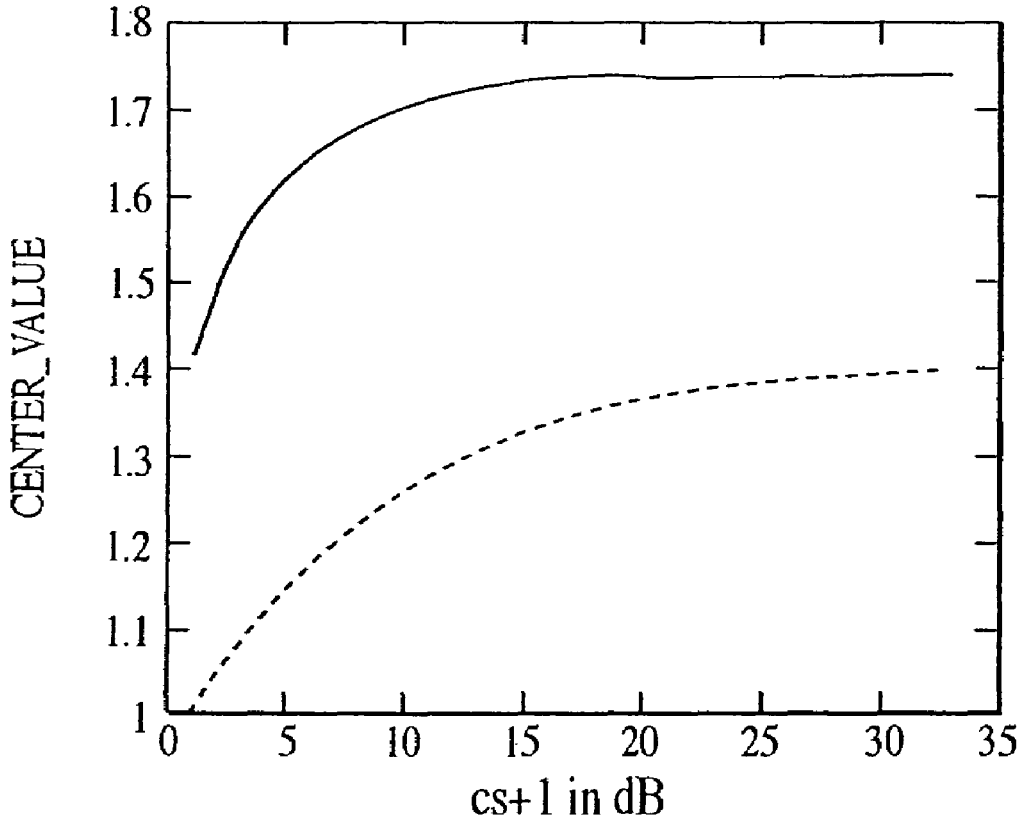
FIG. 17 is a graph showing the ideal values for the center matrix elements of the Dolby® Pro-Logic® decoder (the solid curve), and the actual values of the center matrix elements used in the Dolby® Pro-Logic® decoder (the dotted curve)

In FIG. 17, the solid curve shows the value of the center matrix elements assuming equal power ratios to stereo given the matrix elements and the calibration actually used in Dolby® Pro-Logic. The dotted curve shows the actual values of the center matrix elements in Pro-Logic® The actual values are more than 3 dB too low for all values of cs.

These two figures show something of which mix engineers are often aware—that a mix prepared for playback on a Dolby® Pro-Logic® system can require more center loudness than a mix prepared for playback in stereo. Conversely, a mix prepared for stereo playback will lose vocal clarity when played over a Dolby® Pro-Logic® decoder. Ironically, this is not true of a passive Dolby® Surround® decoder.

14. Creating Two Independent Rear Outputs

The major problem with both the elements of the '89 patent and the elements of the Dolby® Pro-Logic® decoder is that there is only a single rear output. The '92 patent disclosed a method for creating two independent side outputs, and the math in the '92 patent was incorporated in the elements of the front left quadrant of reference [1] and the November '96 application. The goal for the elements in this quadrant was to eliminate the output of a signal steered from left to center, while maintaining some output from the left rear channel for unsteered material present at the same time. To achieve this goal, it was assumed that the LRL matrix element would have the following form for the left front quadrant:

$$LRL=1-GS(lr)-0.5*G(cs) \tag{16a}$$

$$LRR=-0.5*G(cs)-G(lr) \tag{16b}$$

These matrix elements are very similar to the elements in the '89 patent, but further include a G(lr) term in LRR, and a GS term in LRL. G(lr) was included to add signals from the B input channel of the decoder to the left rear output to provide some unsteered signal power as the steered signal was being removed. GS(lr) was determined according to the criterion that there should be no signal output with a fully steered signal that is moving from left to center. The formula for GS(lr) was determined to be equal to $G^2$(lr). However, a more complicated representation of the formula is given in the '92 patent. The two representations can be shown to be identical.

Figure 18:
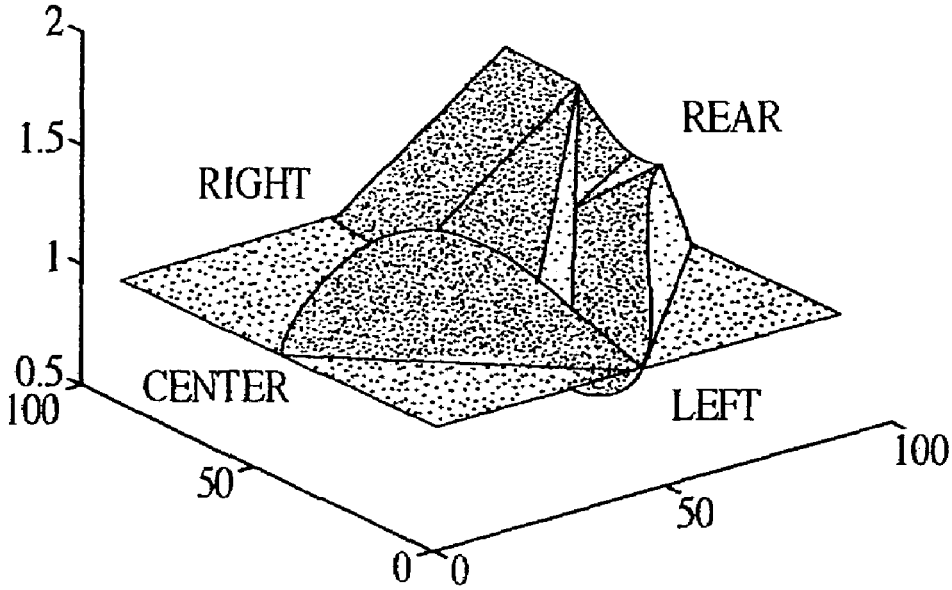
FIG. 18 is a three-dimensional graph of the square root of the sum of the squares of the LRL and Left Rear Right (LRR) matrix elements, using the matrix elements of V1.11.
Figure 20:
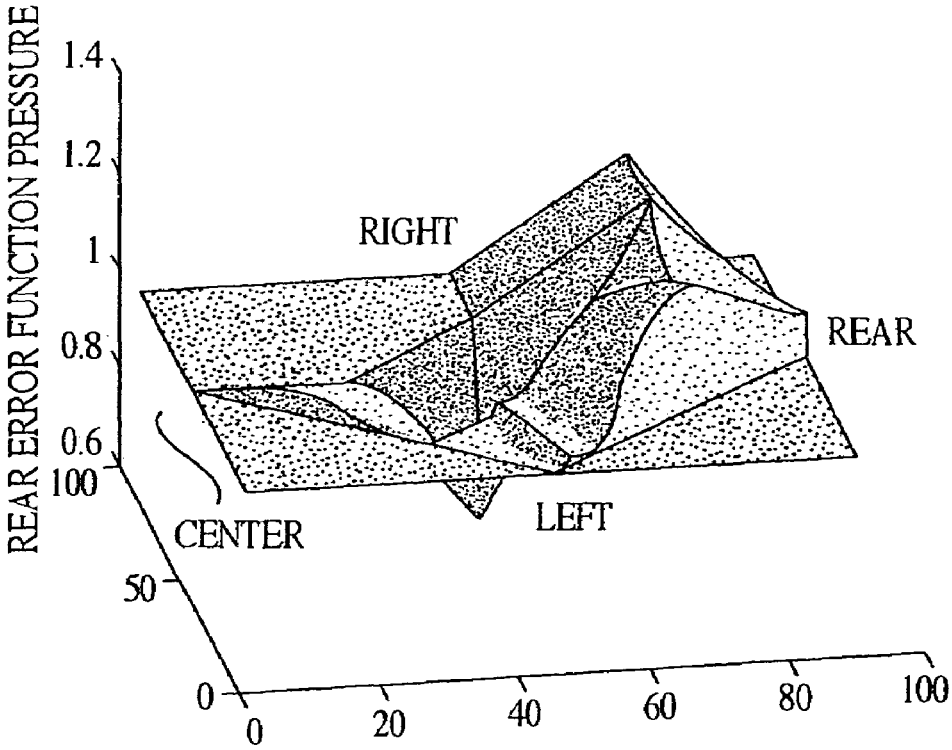
FIG. 20 is a three-dimensional graph of the square root of the sum of the squares of LRL and LRR using values for GR and GS determined according to the present invention.

In reference [1] these elements are corrected by a boost of (sin(cs)+cos(cs)) so that they more closely approximate constant loudness for unsteered material. While completely successful in the right front quadrant, this correction is not very successful in the left front quadrant. As shown in FIG. 18, the matrix elements are identical to the LRL and LRR elements in the '89 patent for the right front quadrant. In FIG. 18, there is a 3 dB dip along the line from the middle to the left vertex in the front left quadrant, and nearly a 3 dB boost in the level along the boundary between left and center. The "mountain range" in the rear quadrant will be discussed later. For the plot shown in FIG. 18, the "tv matrix" correction in V1.11 has been removed to allow better comparison to the present invention, which is shown in FIG. 20.

Several problems with the sound power are shown in FIG. 18. For example, there is a dip in the sum of the squares along the cs=0 axis. This dip exists because the functional shape of G(lr) in LRR is not optimal. In fact, the choice of G(lr) was arbitrary. This function already existed in an earlier design of the decoder, and was easily implemented in analog circuitry.

It may be desirable to have a function GR(lr) in this equation, choose GS(lr) and GR(lr) in such a way as to keep the sum of the squares of LRL and LRR constant along the cs=0 axis, and keep the output zero along the boundary between left and center. It may also be desirable for the matrix elements to be identical to the matrix elements in the right front quadrant along the lr=0 axis. It is assumed that:

$$LRL=\cos(cs)-GS(lr) \tag{17a}$$

$$LRR=-\sin(cs)-GR(lr) \tag{17b}$$

So that the sum of the squares are one along the cs=0 axis:

$$(1-GS(lr))^2+(GR(lr))^2=1 \tag{18}$$

and so that the output is zero for a steered signal, or as t varies from zero to 45 degrees:

$$LRL*\cos(t)+LRR*\sin(t)=0 \tag{19}$$

Figure 19:
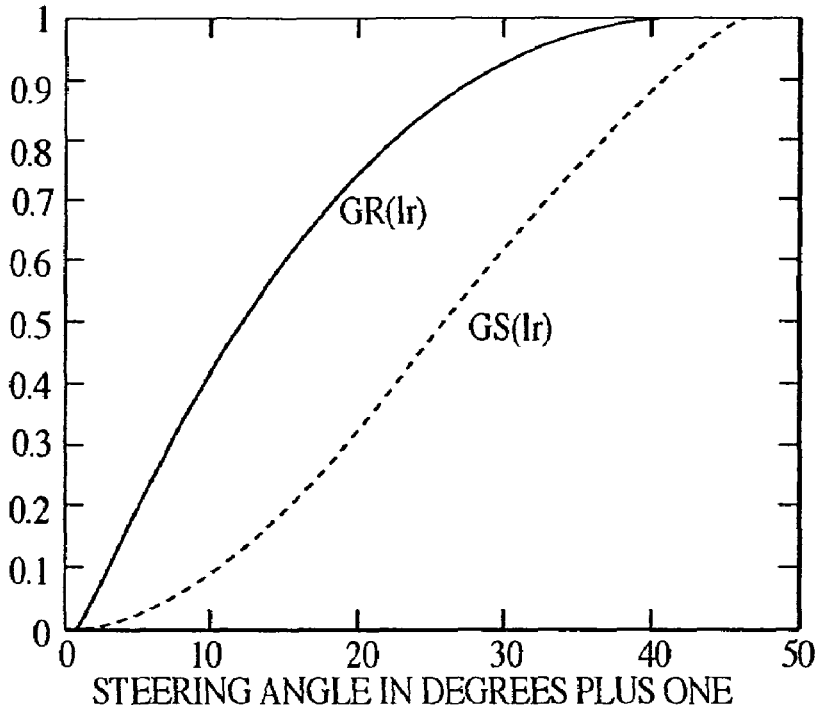
FIG. 19 is a graph of the numerical solution for GS(lr) and GR(lr) that result in a constant power level along the cs=0 axis and zero output along the boundary between left and center.

When solving for GR(lr) and GS(lr), equations (18) and (19) result in a messy quadratic equation, which is solved numerically and shown in FIG. 19. As intended, use of the values obtained for GS and GR, as shown in FIG. 19, results in a large improvement in the power sum along the cs=0 axis. However, the peak in the sum of the squares along the boundary between left and center (shown in FIG. 18) remains.

In a practical design it is probably not very important to compensate for this error. However, this compensation may be accomplished heuristically by dividing both matrix elements by a factor that depends on a new combined variable ("xymin") that is based on lr and cs. Alternatively, both matrix elements may be multiplied by the inverse of xymin. For example, in Matlab notation:

```
% find the minimum of x or y
    xymin = x;
    if(xymin > y)
        xymin = y;
    end
```

-continued

```
    if(xymin > 23)
        xymin = 23;
    end
% note that xymin varies from zero to 22.5 degrees.
```

The correction to the matrix elements along the boundary may be found using xymin. In the front left quadrant:

$$LRL=(\cos(cs)-GS(lr))/(1+0.29*\sin(4*xymin)) \quad (20a)$$

$$LRR=(-\sin(cs)-GR(lr))/(1+0.29*\sin(4*xymin)) \quad (20b)$$

In the front right quadrant:

$$LRL=\cos(cs) \quad (20c)$$

$$LRR=-\sin(cs) \quad (20d)$$

In reference [2], these elements are also multiplied by the "tv matrix" correction. FIG. 20 shows the matrix elements without the "tv matrix" correction. The "tv matrix" correction is handled by frequency dependent circuitry that follows the matrix, which will be described later. As shown in FIG. 20, the sum of the squares is close to one and continuous, except for the deliberate rise in level in the rear.

15. The Rear Matrix Elements During Rear Steering

The rear matrix elements given in the '92 patent were not appropriate for a five-channel decoder, and, therefore, may be modified heuristically. Reference [1] and the November '96 application presented a mathematical method for deriving these elements along the boundary of the left rear quadrant. The method worked along the boundary, but resulted in discontinuities along the lr=0 axis, and the cs=0 axis. These discontinuities were mostly repaired by additional corrections to the matrix elements, which preserved the behavior of the matrix elements along the steering boundaries.

These discontinuities may also be corrected using interpolation. A first interpolation fixes discontinuities along the cs=0 boundary for LRL. This interpolation causes the value of LRL to match the value of GS(lr) when cs is zero, and allows the value of LRL to rise smoothly to the value given by the previous math as cs increases negatively toward the rear. A second interpolation causes the value of LRR to match the value of GR(lr) along the cs=0 axis.

16. Left Side/Rear Outputs During Rear Steering from Right to Right Rear

Consider the LRL and LRR matrix elements when the steering is neutral or anywhere between full right and right rear (lr can vary from 0 to −45 degrees, and cs can vary from 0 to −22.5 degrees). Under these conditions, the steered component of the input should be removed from the left outputs, which means there should be no output from the rear left channel when the steering is toward the right or right rear.

The matrix elements given in the −92 patent achieve this goal and are essentially the same as the rear matrix elements in a 4 channel decoder with the addition of a sin(cs)+cos(cs) correction for the unsteered loudness. Therefore, the matrix elements are simple sines and cosines and are defined according to the following equations:

$$LRL=\cos(-cs)=sri(-cs) \quad (21a)$$

$$LRR=\sin(-cs)=sric(-cs) \quad (21b)$$

where sric(x) is equal to sin(x) over a value with a range of 0 to 22.5 degrees, and sri(x) is equal to cos(x). These functions will also be used to define the Left Rear matrix elements during Left steering.

17. Left Side and Rear Outputs During Rear Steering from Right Rear to Rear

Consider the same matrix elements as cs becomes greater than −22.5 degrees (cs varies from −22.5 to −45). As stated in reference [1], the July '96 application and the November '96 application, LRL should rise to one or more over this range, and LRR should decrease to zero. Simple functions fulfill these requirements:

$$LRL=(\cos(45+cs)+r\text{boost}(-cs))=(sri(-cs)+r\text{boost}(-cs)) \quad (22a)$$

$$LRR=\sin(45+cs)=sric(-cs) \quad (22b)$$

where rboost(cs) is defined in reference [1] and the November '96 application. rboost(cs) is closely equivalent to the function 0.41*G(cs) in the earlier matrix elements, except that rboost(cs) is zero for 0>cs>−22.5, and varies from zero to 0.41 as cs varies from −22.5 degrees to −45 degrees. The exact functional shape of rboost(cs) is determined by the desire to keep the loudness of the rear output constant as sound is panned from left rear to full rear. The Left Rear matrix elements during right steering are now complete.

18. The Left Rear Matrix Elements During Steering from Left to Left Rear

The behavior of the LRL and LRR matrix elements is complex. The LRL element must quickly rise from zero to near maximum as lr decreases from 45 to 22.5 or to zero. The matrix elements given in reference [1] satisfy this requirement, but as shown previously, there are problems with continuity at the cs=0 boundary.

One solution to the continuity problems uses functions of one variable and several conditionals. In reference [1], the problem at the cs=0 boundary arises because the LRL matrix element is given by GS(lr) on the forward side of the boundary (cs>0). On the rear side of the boundary (cs<0), the function given by reference [1] has the same end points, but is different when lr is not zero or 45 degrees.

The mathematical method in reference [1] provides the following equations for the Left Rear matrix elements over the range 22.5<lr<45 (in reference [1],t=45−lr):

$$\begin{aligned} LRL &= \cos(45-lr)*\sin(4*(45-lr)) - \\ &\quad \sin(45-lr)*\cos(4*(45-lr)) \\ &= sra(lr) \end{aligned} \quad (23a)$$

$$\begin{aligned} LRR &= -(\sin(45-lr).*\sin(4*(45-lr)) + \\ &\quad \cos(45-lr).*\cos(4*(45-lr))) \\ &= srac(lr) \end{aligned} \quad (23b)$$

where sra(lr) and srac(lr) are two new functions defined over this range.

If cs≧22.5, lr can still vary from 0 to 45. Reference [1] defines LRL and LRR (when the range of lr is 0<lr<22.5; see FIG. 6 in reference [1]), respectively, as:

$$LRL=\cos(lr)=sra(lr) \quad (23c)$$

$$LRR=-\sin(lr)=-srac(lr) \quad (23d)$$

which defines the two functions sra(x) and srac(x) for 0<lr<45.

19. March 1997 Version

There are two discontinuities in the March 1997 version. Along the cs=0 boundary, the LRR for the rear must match the LRR for the forward direction, which shows LRR=−G (lr) along the cs=0 boundary. A somewhat computationally intensive interpolation, which is based on cs over the range of values of 0 to 15 degrees, is used to correct LRR. When cs is zero G(lr) is employed to find LRR and as cs increases to 15 degrees, LRR is interpolated to the value of srac(lr).

A discontinuity along the lr=0 axis is also possible. This discontinuity was corrected somewhat by adding a term to LRR, which is found by using a new variable ("cs_bounded"). The correction term becomes simply sric(cs_bounded), which will insure continuity across the lr=0 axis. cs_bounded may be defined according to the following Matlab notation:

```
cs_bounded = lr − cs;
if(cs bounded < 1) % this limits the maximum value
    cs_bounded = 0;
end
if(45−|lr| < cs_bounded) % use the smaller of the two values
    cs_bounded = 45−lr;
end
for cs = 0 to 15
    LRR = (−(srac(lr) + (srac(lr)−G(lr))*(15−cs)/15) +
    sric(cs_bounded));
for cs= 15 to 22.5
    LRR = (−srac(lr) + sric(cs_bounded));
```

20. LRL as Implemented in the Present Invention

In the present invention, LRL is computed using an interpolation similar to that used for LRR. In Matlab notation:

for cs=0 to 15

$$LRL=((sra(lr)+(sra(lr)-GS(lr))*(15-cs)/15)+sri(-cs));$$

for cs=15 to 22.5

$$LRL=(sra(lr)+sri(-cs));$$

21. Rear Outputs During Steering from Left Rear to Full Rear

As the steering goes from left rear to full rear the elements follow those given in reference [1], however, corrections for rear loudness are added. In Matlab notation:

For cs>22.5, lr<22.5

$$LRL=(sra(lr)+sri(cs)+\text{rboost}(cs))$$

$$LRR=-srac(lr)+sric(cs_\text{bounded})$$

This completes the LRL and LRR matrix elements during left steering. The values for right steering can be found by swapping left and right in the definitions.

22. Center Matrix Elements

The '89 patent and Dolby® Pro-Logic® both have center matrix elements defined by equations (24a), (24b), (24c) and (24d). For front steering:

$$CL=1-G(lr)+0.41*G(cs) \tag{24a}$$

$$CR=1+0.41*G(cs) \tag{24b}$$

For rear steering:

$$CL=1-G(lr) \tag{24c}$$

$$CR=1 \tag{24d}$$

Figure 21:
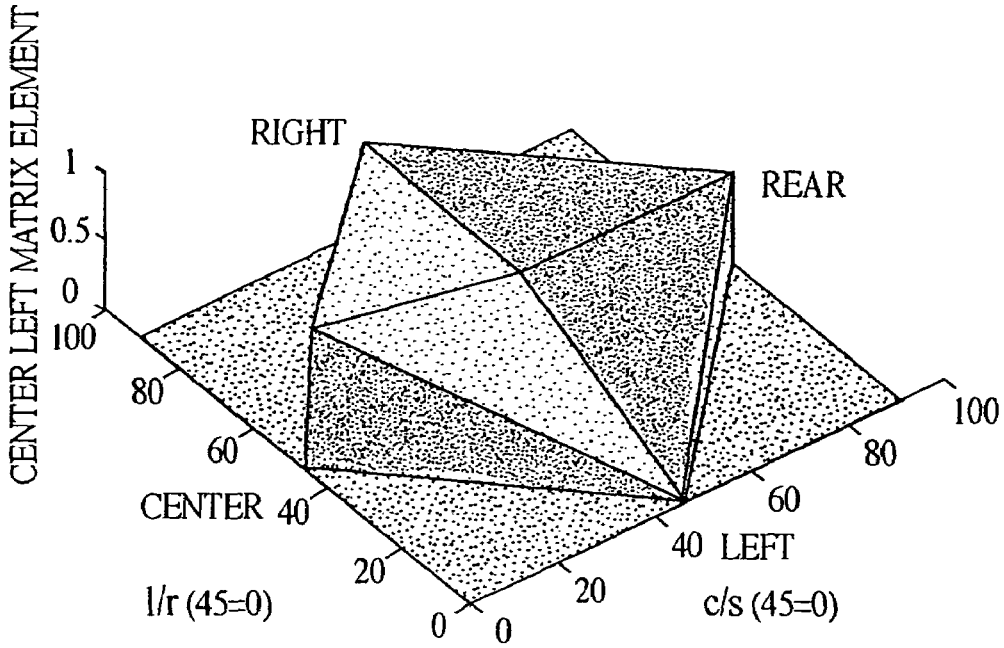
FIG. 21 is a three-dimensional graph of the Center Left (CL) matrix element of the four channel decoder in the '89 patent and the Dolby® Pro-Logic® decoder, which can also represent the Center Right (CR) matrix element with left and right interchanged.

Because the matrix elements have symmetry about the left/right axis, the values of CL and CR for right steering can be found by swapping CL and CR. FIG. 21 shows a graphical representation of CL, in which the middle of the graph and the right and rear vertices have the value 1, and the center vertex has the value 1.41. In practice, this element is scaled so that its maximum value is one.

In the November '96 application and reference [1], these elements are defined by sines and cosines according to equations (25a) and (25b). For front steering:

$$CL=\cos(-45-lr)*\sin(2*(45-lr))-\sin(45-lr)*\cos(2*(45-lr))+0.41*G(cs) \tag{25a}$$

$$CR=\sin(45-lr)*\sin(2*(45-lr))+\cos(45-lr)*\cos(2*(45-lr))+0.41*G(cs) \tag{25b}$$

However, the March 1997 version used the elements defined in the '89 patent, but with a different scaling, and a boost function different than G(cs). It was important to reduce the unsteered level of the center output, therefore, a value 4.5 dB less than the value used in Dolby® Pro-Logic® was chosen and the boost function (0.41*G(cs)) was changed to increase the value of the matrix elements back to the value used in Dolby® Pro-Logic® as cs increases toward center. The boost function in the March 1997 version was chosen heuristically through listening tests.

Figure 22:
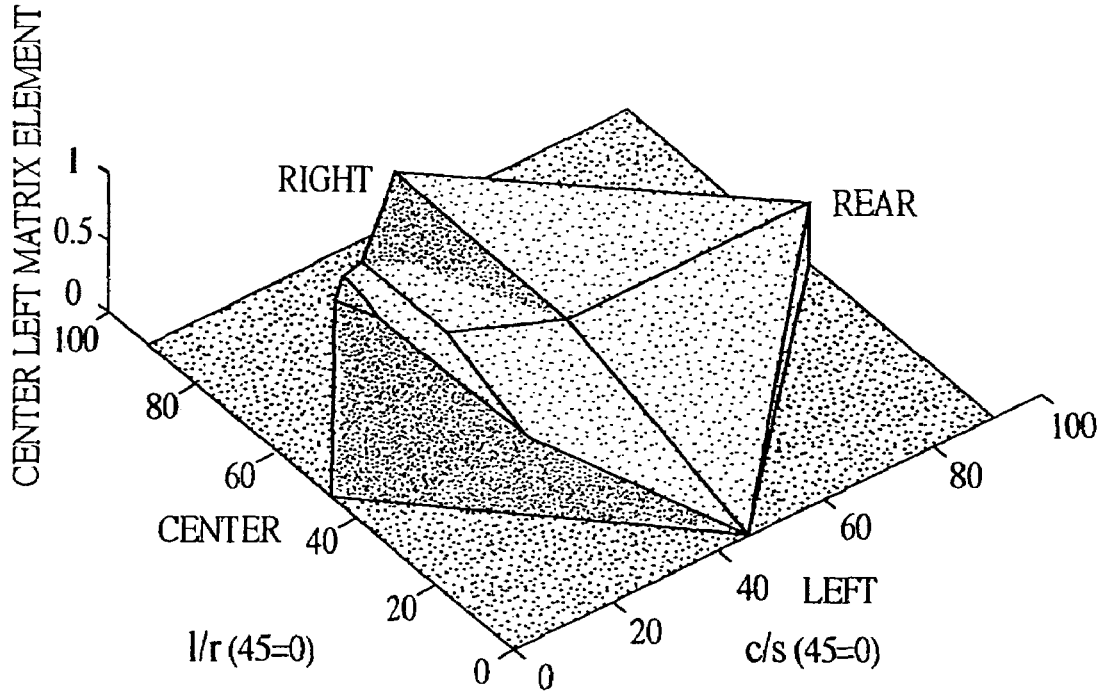
FIG. 22 is a three-dimensional graph of the Center Left (CL) matrix element in V1.11.

In the March 1997 version, the boost function of cs starts at zero as before, and increases with cs such that CL and CR increase by 4.5 dB as cs goes from zero to 22.5 degrees. The increase in CL and CR is a constant number (in dB) for each dB of increase in cs. The boost function then changes slope such that the matrix elements increase another 3 dB in the next 20 degrees and then remain constant. Thus, the new matrix elements are equal to the neutral values of the old matrix elements when the steering is "half front" (8 dB or 23 degrees). As the steering continues to move forward, the new and the old matrix elements become equal. The output of the center channel is thus 4.5 dB lower than the old output when steering is neutral, but increases to the old value when the steering is fully to the center. FIG. 22 shows a three-dimensional plot of the CL matrix element. In this plot, the middle value and the right and rear vertices have been reduced by 4.5 dB. Additionally, as cs increases, the center rises to the value of 1.41 in two slopes.

However, the center elements used in the March 1997 version are not optimal. Considerable experience with the decoder in practice has shown that the center portion of popular music recordings and the dialog in some films tends to get lost when switching between stereo (two channel) reproduction, and reproduction using the matrix. In addition, a listener who is not equidistant from the front speakers can notice the apparent position of a center voice moving as the level of the center channel changes. This problem was extensively analyzed as the new center matrix elements presented here were developed. There is also a problem when a signal pans from left to center or from right to center along the boundary. The matrix elements given in the November '96 application result in a center speaker output that is too low when the pan is half way between.

23. Center Channel in the New Design

While it is possible to remove a strongly steered signal from the center channel output using matrix techniques, any time the steering is frontal but not biased either left or right, the center channel must reproduce the sum of the A and B inputs with some gain factor. In other words, it is not possible to remove uncorrelated left and right material from the center channel. The only option is to regulate the loudness of the center speaker.

How loud the center speaker should be depends on the behavior of the left and right main outputs. The matrix values presented above for LFL and LFR are designed to remove the center component of the input signals as the steering moves forward. If the input signal has been encoded to come from the forward direction using a cross mixer, such as a stereo width control, the matrix elements given above (the elements of the '89 patent, reference [1], the March 1997 version, and those presented earlier in this paper) completely restore the original separation.

However, the input to the decoder may consist of uncorrelated left and right channels to which an unrelated center channel has been added. For example, the input channels may be defined according to the following equations:

$$A_{in}=L_{in}+0.71*C_{in} \tag{26a}$$

$$B_{in}=R_{in}+0.71*C_{in} \tag{26b}$$

When this is the case, as the level of $C_{in}$ increases relative to $L_{in}$ and $R_{in}$, the C component of the L and R front outputs of the decoder is not completely eliminated unless $C_{in}$ is large compared to $L_{in}$ and $R_{in}$. In general, a bit of $C_{in}$ remains in the L and R front outputs. However, what will a listener hear?

There are two ways of calculating what a listener hears depending on whether the listener is exactly equidistant from the Left, Right, and Center speakers. If a listener is exactly equidistant from the Left, Right, and Center speakers, they will hear the sum of the sound pressures from each speaker. This is equivalent to summing the three front outputs. When the listener is in this position, any reduction of the center component of the left and right speakers will result in a net loss of sound pressure from the center component, regardless of the amplitude of the center speaker. This net loss of sound pressure from the center component is a result of deriving the signal in the center speaker from the sum of the A and B inputs. Therefore, as the amplitude of the signal in the center speaker is raised, the amplitude of the $L_{in}$ and $R_{in}$ signals must rise along with the amplitude of the $C_{in}$ signal.

However, if the listener is not equidistant from each speaker, the listener is much more likely to hear the sum of the sound power from each speaker, which is equivalent to the sum of the squares of the three front outputs. In fact, extensive listening has shown that the sum of the sound power from each speaker is actually what is important. Therefore, the sum of the squares of all the outputs of the decoder, including the rear outputs, must be considered.

To design the matrix so that the ratio of the amplitudes of $L_{in}$, $R_{in}$, and $C_{in}$ are preserved when switching between stereo reproduction and matrix reproduction, the sound power of the $C_{in}$ component from the center output must rise in exact proportion to the reduction in the sound power of the $C_{in}$ component from the left and right outputs, and the reduction in the sound power of the $C_{in}$ component in the rear outputs. An additional complication comes from the up to 3 dB level boost applied to the left and right front outputs (described previously). Because of the level boost, the center will need to be somewhat louder to keep the ratios constant. This requirement may be expressed as a set of equations for the sound power. Using these equations, a gain function, which can be used to increase the loudness of the center speaker, can be determined.

Figure 23:
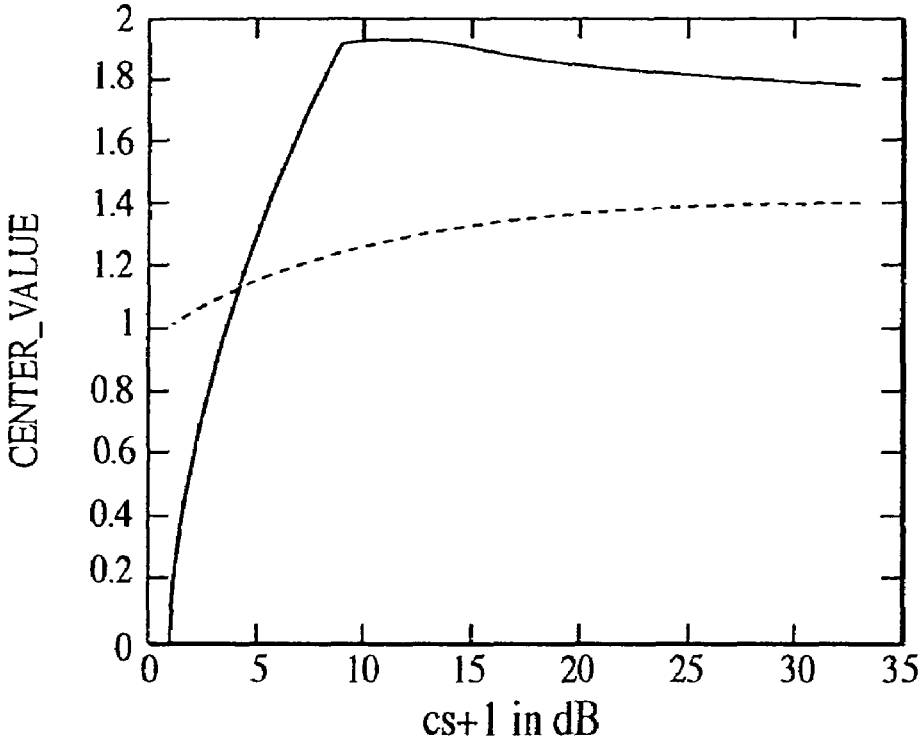
FIG. 23 is a graph showing the center output channel attenuation needed for the new LFL and LFR matrix elements (the solid curve), and the center attenuation for a standard Dolby® Pro-Logic® decoder (the dotted curve)
Figure 24:
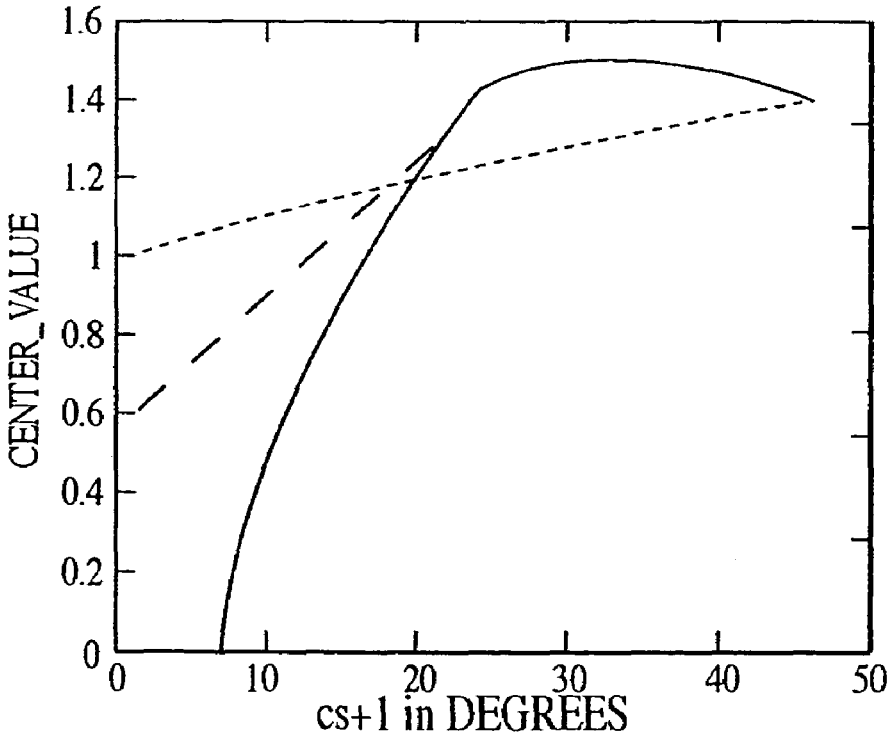
FIG. 24 is a graph showing the ideal center attenuation for the "film" strategy (the solid curve), another center attenuation for the "film" strategy (the dashed curve), and the center attenuation for the standard Dolby® decoder (the dotted curve)

The solid curve of FIG. 23 shows the center gain needed to preserve the energy of the center component of the input signal in the front three channels as steering increases toward the front. The dotted curve of FIG. 24 shows the gain in a standard decoder. As shown by the solid curve, the level of the center channel requires a steep increase—on the order of many dB of amplitude per dB of steering value.

As previously mentioned, there are two solutions to this problem. One solution is the "film" solution, which is not entirely mathematical. The function shown in FIG. 23 rose too steeply, in that the change in level of the center channel was too obvious. Therefore, the power requirement was relaxed slightly so that the power in the center was about 1 dB less than the ideal. The relaxed power requirement may be used to recalculate the center values, which are indicated by the solid line of FIG. 24. In practice a linear rise can be substituted for the early part of the curve, as indicated by the dashed line in FIG. 24. These center values have yielded excellent results for films. Because the curve indicated by the solid line in FIG. 24 rises to steeply, the linear slope indicated by the dashed line works better.

In contrast, music requires a different solution. The center attenuation shown in FIGS. 23 and 24 was derived using the matrix elements previously given for LFL and LFR. However, what if different elements were used? Specifically, would the center component need to be aggressively removed from the left and right front outputs?

Listening tests show that the previous left and right front matrix elements are needlessly aggressive about removing the center component during music playback. Acoustically there is no need. Energy removed from the left and right front must be given to the center loudspeaker. If, however, this energy is not removed, it will come from the left and right front speakers, and, therefore, the center speaker need not be as strong and the sound power in the room remains the same. The trick is to put just enough energy into the center speaker to create a convincing front image for an off-axis listener, while minimizing the reduction of stereo width for a listener who is equidistant from the front left and right speakers.

As done in the November '96 application, the optimal center loudness can be found by trial and error. The matrix elements needed in the front left and right to preserve the power of the $C_{in}$ component in the room may then be determined. As before, it is assumed that the center channel is reduced in level by 4.5 dB below the level in the decoder disclosed in the '89 patent, which is a total attenuation of −7.5 dB total attenuation, which is about 0.42. The matrix elements for the center can be multiplied by this factor, and a new center boost function (GC) can be defined.

For front steering:

$$CL=0.42*(1-G(lr))+GC(cs) \tag{27a}$$

$$CR=0.42+GC(cs) \tag{27b}$$

For rear steering:

$$CL=0.42*(1-G(lr)) \tag{27c}$$

$$CR=0.42 \tag{27d}$$

Several functions were tried for GC(cs). The function given below may not be ideal, but seems good enough. The function is specified in terms of the angle cs in degrees, and was obtained by trial and error.

In MATLAB notation:

```
center_max = 0.65;
center_rate = 0.75;
center_max2 = 1;
center_rate2 = 0.3;
center_rate3 = 0.1;
if(cs < 12)
    gc(cs-1) = 0.42* 10, (db*center_rate/(20));
    tmp = gc(cs + 1);
elseif(cs < 30)
gc(cs + 1) = tmp*10^((cs-11)*center_rate3/(20));
    if(gc(cs + 1) > center_max)
        gc(cs + 1) = center_max;
    end
else
    gc(cs+1) = center_max*10^((cs-29)*center_rate2/(20));
    if(gc(cs+ 1) > center_max2 )
        gc(cs+ 1) = center_max2;
    end
end
```

Figure 25:
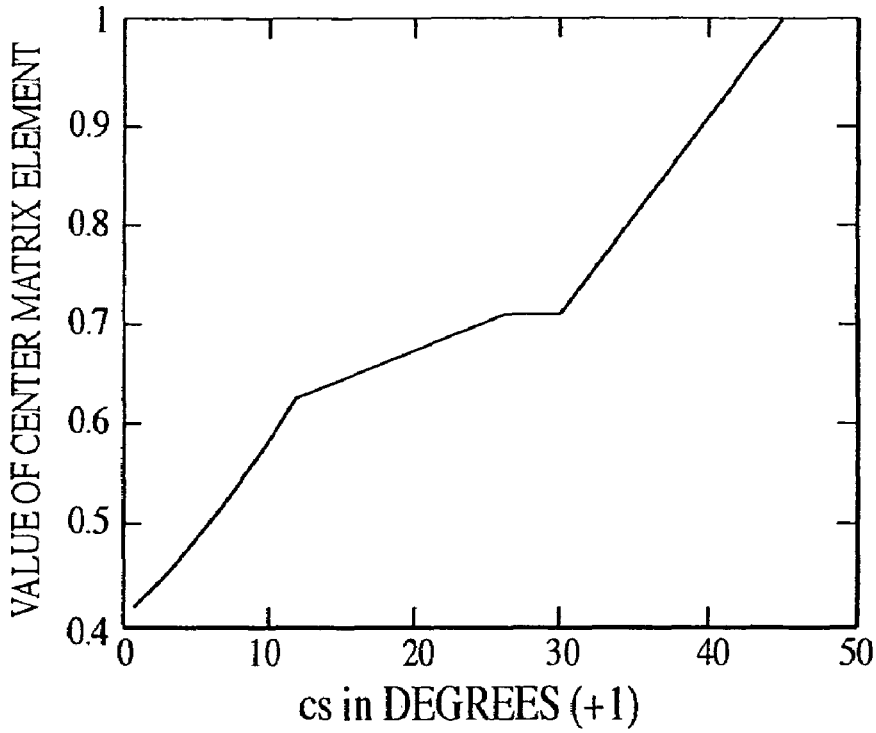
FIG. 25 shows the center attenuation used for the "music" strategy.

The function (0.42+GC(cs)) is plotted in FIG. 25. Note the quick rise from the value 0.42 (4.5 dB lower than Dolby® Surround®), followed by a gentle rise, and finally by a steep rise to the value 1.

The function needed for LFR may be determined if functions for LFL, LRL, and LRR are assumed. This involves determining the rate at which the $C_{in}$ component in the left and right outputs should decrease, and then designing matrix elements that provide this rate of decrease. These matrix elements should also provide some boost of the $L_{in}$ and $R_{in}$ components, and should have the current shape at the left to center boundary, as well as the right to center boundary. It is assumed that:

$$LFL=GP(cs) \tag{28a}$$

$$LFR=GF(cs) \tag{28b}$$

$$CL=0.42*(1-G(lr))+GC(cs) \tag{28c}$$

$$CR=0.42+GC(cs) \tag{28d}$$

Power from the front left and right can then be computed as follows:

$$PLR=(GP^2+GF^2)*(L_{in}^2+R_{in}^2)+(GP-GF)^2*C_{in}^2 \tag{29a}$$

Power from the center is:

$$PC=GC^2*(L_{in}^2+R_{in}^2)+2*GC^2*C_{in}^2 \tag{29b}$$

Power from the rear depends on the matrix elements used. It was assumed that the rear channels are attenuated by 3 dB during forward steering, and that LRL is cos(cs) and LRR is sin(cs). From a single speaker:

$$PREAR=(0.71*(\cos(cs)*(L_{in}+0.71*R_{in})-\sin(cs)*(R_{in}+0.71*Cin)))^2 \tag{29c}$$

If it is assumed that $L_{in}^2 \approx R_{in}^2$, then, for two speakers:

$$PREAR=0.5*C_{in}^2*((\cos(cs)-\sin(cs))^2)+L_{in}^2 \tag{29d}$$

The total power from all three speakers is PLR+PC+PREAR:

$$PT=(GP^2+GF^2+GC^2)*(L_{in}^2+R_{in}^2)+((GP-GF)^2+2*GC^2)*C_i^{n2}+PREAR \tag{30}$$

The ratio of $C_{in}$ power to $L_{in}$ and $R_{in}$ power (assuming $L_{in}^2=R_{in}^2$) is:

$$RATIO = (((GP(cs)-GF(cs))^2+2*(GC(cs)^2)+0.5*(\cos(cs)-\sin(cs))^2))*C_{in}^2/((2*(GP(cs)^2+GC(cs)^2+GF(cs)^2)+1)*L_{in}^2) \tag{31a}$$

$$RATIO = (C_{in}^2/L_{in}^2)*((GP(cs)-GF(cs))^2+2*(GC(cs)^2)+0.5*(\cos(cs)-\sin(cs))^2)/(2*(GP(cs)^2+GC(cs)^2+GF(cs)^2)+1) \tag{31b}$$

For normal stereo, GC=0, GP=1, and GF=0. Therefore, the center to LR power ratio is:

$$RATIO=(C_{in}^2/L_{in}^2)*0.5 \tag{32}$$

If this ratio is to be constant regardless of the value of $C_{in}^2/L_{in}^2$ for the active matrix, then:

$$((GP(cs)-GF(cs))^2+2*(GC(cs)^2)+0.5*(\cos(cs)-\sin(cs))^{2)}=((GP(cs)^2+GC(cs)^2+GF(cs)^2)+0.5) \tag{33}$$

Figure 26:
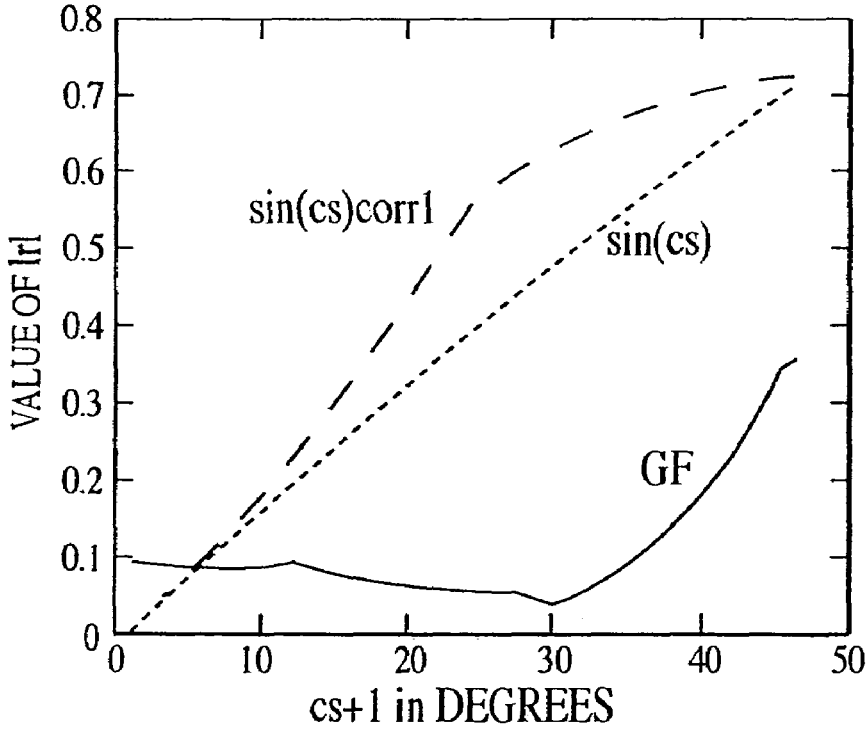
FIG. 26 is a graph showing the value of GF needed for constant energy ratios with the "music" center attenuation GC (the solid curve), the previous value of the LFR matrix element sin(cs)*corr1 (the dashed curve), and the value of sin(cs) (the dotted curve)

The equation above can be solved numerically. Assuming the GC above, and GP=LFL as before, the result is shown in FIG. 26. In FIG. 26 the solid curve is the GF needed for constant energy ratios with the new "music" center attenuation GC. The dashed curve is the LFR element of the March '97 version (sin(cs)*corr1). The dotted curve is sin(cs), which is the LFR element without the correction term corr1. Note that GF is close to zero until cs reaches 30 degrees, and then GF increases sharply. In practice it is best to limit the value of cs to about 33 degrees. In practice, the LFR element derived from these curves has a negative sign.

GF gives the shape of the LFR matrix element along the lr=0 axis, as cs increases from zero to center. A method is needed of blending this behavior to that of the previous LFR element, which must be preserved along the boundary between left and center, as well as from right to center. A method of doing this when cs≦22.5 degrees is to define a difference function between GF and sin(cs). This function may then be limited in various ways. In Matlab notation:

```
gf_diff = sin(cs) - gf(cs):
for cs = 0:45;
    if(gf_diff(cs) > sin(cs))
        gf_diff(cs) = sin(cs);
    end
    if(gf_diff(cs) < 0)
        gf_diff(cs) = 0;
    end
end
%find the bounded c/s
    if(y < 24)
        bcs = y-(x-1);
        if(bcs< 1) % this limits the maximum value
            bcs = 1;
        end
    else
        bcs = 47-y-(x-1);
        if(bcs < 1) %> 46)
            bcs = 1; %46;
        end
    end
```

The LFR element can now be written in Matlab notation:

```
% this neat trick does an interpolation to the boundary
% the cost, of course, is a divide!!!
if(y < 23) % this is the easy way for half the region
    lfr3d(47-x,47-y) = -sin_tbl(y)+gf_diff(bcs);
else
    tmp - ((47-1-x)/(47-1))*gf_diff(y);
    lfr3d(47-x,47-y) = -sin_tbl(y)+tmp;
end
```

Note that the sign of gf_diff is positive in the equation above. Thus gf_diff cancels the value of sin(cs), reducing the value of the element to zero along the first part of the lr=0 axis, as shown in FIG. 27.

Figure 27:
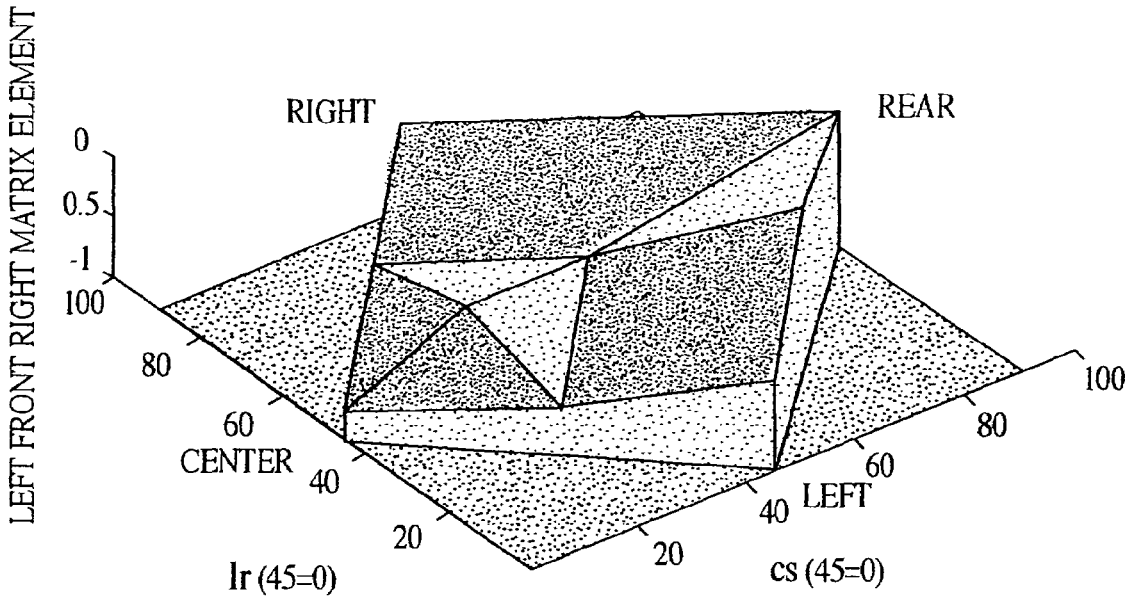
FIG. 27 is a three-dimensional graph of the LFR matrix element, including the correction for center level along the lr=0 axis.

In FIG. 27, the value is zero in the middle of the plane (where there is no steering) and remains zero as cs increases to ~30 degrees along the lr=0 axis. The value then falls off to match the previous value along the boundary from left to center and from right to center.

24. Panning Error in the Center Output

The new center function may be written as follows:

$$CL=0.42*(1-G(lr))+GC(cs) \quad (34a)$$

$$CR=0.42+GC(cs) \quad (34b)$$

As defined in equations (34a) and 34(b), the new center function works well along the lr=0 axis, but causes a panning error along the boundary between left and center, and between right and center. However, the values in reference [1] give a smooth function of cos(2*cs) along the left boundary and create smooth panning between left and center. It is desirable for the new center function to have similar behavior along this boundary.

A correction to the matrix element that will do the job includes adding an additional function "xymin", which may be expressed in Matlab notation as:

```
center_fix_tbl=0.8*(corr1-1);
```

Then:

$$CL=0.42-0.42*G(lr)+GC(cs)+\text{center_fix_table}(xy\text{min}) \quad (35a)$$

$$CR=0.42+GC(cs)+\text{center_fix_table}(xy\text{min}) \quad (35b)$$

Figure 28:
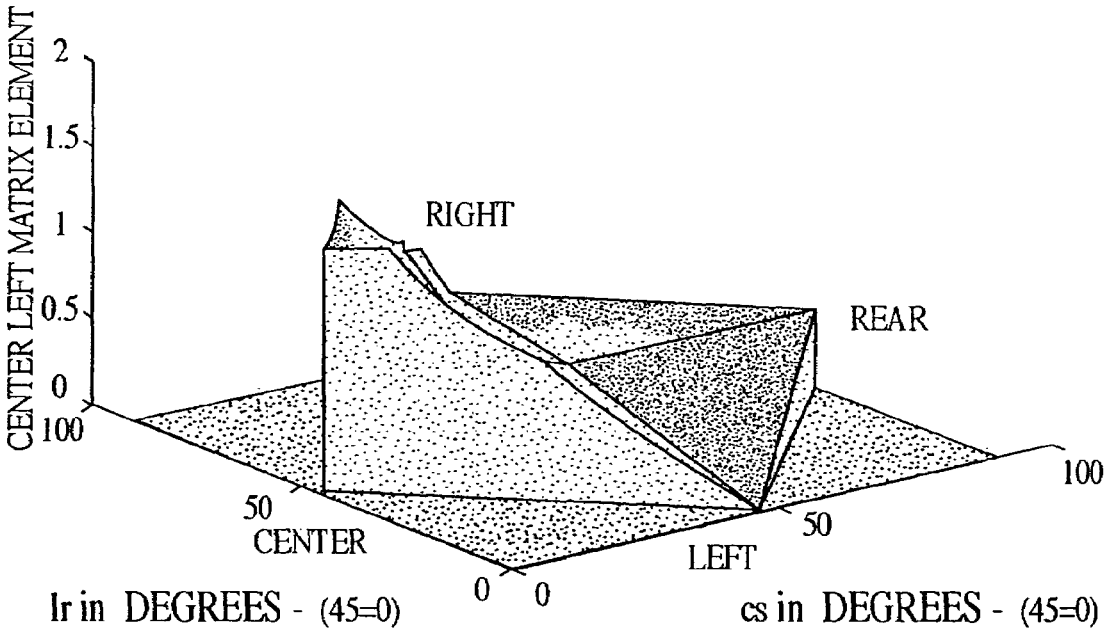
FIG. 28 is a three-dimensional graph of the CL matrix element with the new center boost function.

A three-dimensional representation of the CL matrix element is shown in FIG. 28. While not perfect, this correction works well in practice. In FIG. 28, note the correction for panning along the boundary between left and center, which is fairly smooth.

Figure 29:
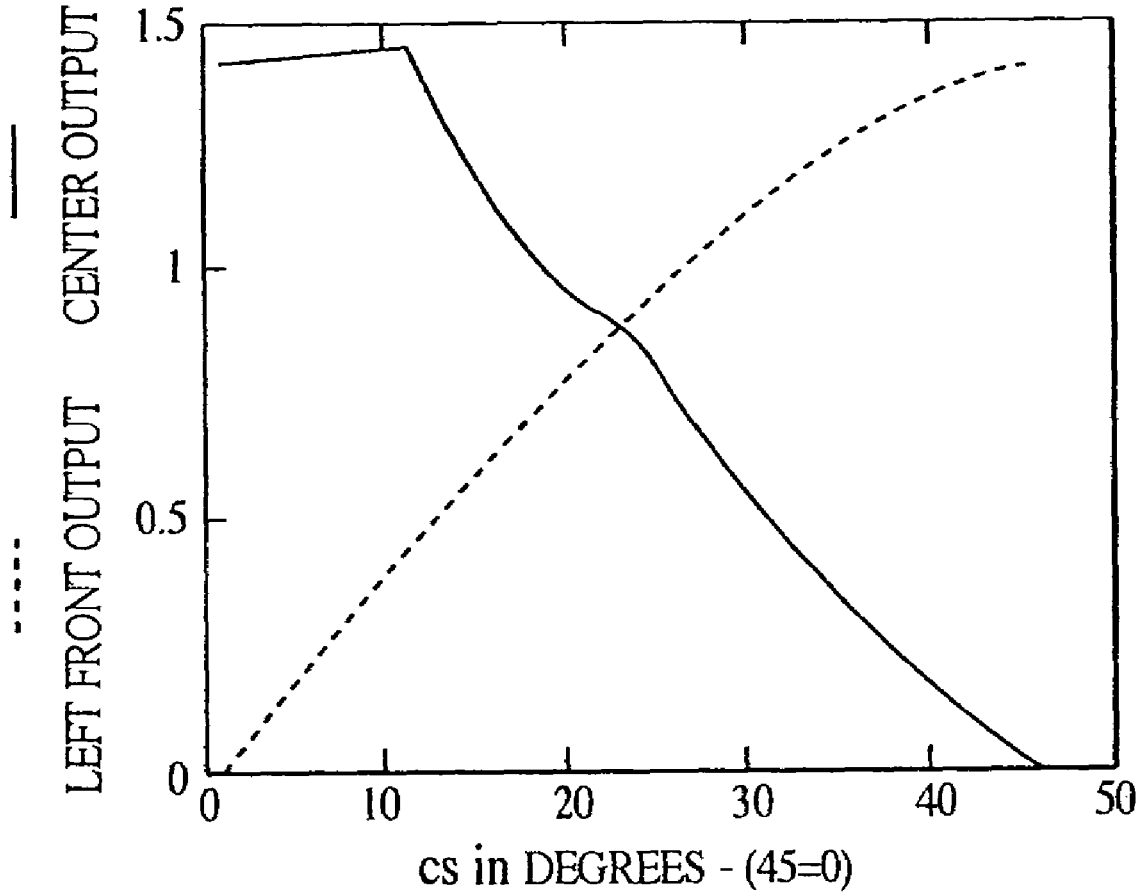
FIG. 29 is a graph of the output level from the left front output (the dotted curve) and the center output (the solid curve) as a strong signal pans from center to left.

FIG. 29 shows a graph of the left front (dotted curve) and center (solid curve) outputs, where the center steering is to the left of the plot, and full left is to the right. In the "music" strategy, the value of cs is limited to about 33 degrees (about 13 on the axis as labeled), where the center is about 6 dB stronger than the left.

25. Technical Details of the Encoder

There are two major goals for the Logic 7® encoder. First, the Logic 7® encoder should be able to encode a 5.1 channel tape in a way that allows the encoded version to be decoded by a Logic 7® decoder with minimal subjective change. Second, the encoded output should be stereo compatible, which means that it should sound as close as possible to a manual two channel mix of the same material. Stereo compatibility should include the output of the encoder giving identical perceived loudness for each sound source in an original 5 channel mix when played on a standard stereo system. The apparent position of the sound source in stereo should also be as close as possible to the apparent position of the sound source in the 5 channel original.

The goal of stereo compatibility, as described above, cannot be met by a passive encoder. A five channel recording where all channels have equal foreground importance must be encoded as described above. This encoding requires that surround channels be mixed into the output of the encoder in such a way as to preserve the energy. That is, the total energy of the output of the encoder should be the same, regardless of which input is being driven. This constant energy setting will be necessary for most film sources and for five channel music sources where instruments have been assigned equally to all 5 loudspeakers, although such music sources are not common at the present time, they will become common in the future.

Music recordings in which the foreground instruments are placed in the front three channels, and reverberation is placed primarily in the rear channels, require a different encoding. Music recordings of this type were successfully encoded in a stereo compatible form when the surround channels were mixed with 3 dB less power than the other channels. This −3 dB level has been adopted as a standard for surround encoding in Europe. However, the European standard specifies that other surround levels can be used for special purposes. The new encoder contains active circuits, which detect strong signals in the surround channels. When the active circuits detect that such signals are occasionally present, the encoder uses full surround level. If the active circuits detect that the surround inputs are consistently −6 dB or less compared to the front channels, the surround gain is gradually lowered 3 dB, which corresponds to that of the European standard.

These active circuits were also present in the encoder in the November '96 application. However, tests involving the encoder of the November '96 application, performed at the Institute for Broadcast Technique (IRT) in Munich, revealed that the direction of some sound sources was encoded incorrectly. Therefore, a new architecture was developed to solve this problem. The new encoder is clearly superior in its performance on a wide variety of difficult material. The original encoder was developed first as a passive encoder. The new encoder will also work in a passive mode, but is primarily intended to work as an active encoder. The active circuitry corrects several small errors inherent in the design. However, even without the active correction, the performance is better than the previous encoder.

Through extensive listening, several other small problems with the first encoder were discovered. Many of these problems have been addressed in the new encoder. For example, when stereo signals are applied to both the front and the rear terminals of the encoder at the same time, the resulting encoder output is biased too far to the front. The new encoder compensates for this by increasing the rear bias slightly. Likewise, when a film is encoded with substantial surround content, dialog can sometimes get lost. This problem was greatly improved by the changes to the power balance described above. However, the encoder is also intended for use with a standard (Dolby®) decoder and compensates for this by raising the center channel input to the encoder slightly when used in this manner.

26. Explanation of the Design

The new encoder handles the left, center, and right signals in a manner identical to that of the previous design and the Dolby® encoder, providing that the center attenuation function fcn is equal to 0.71, or −3 dB.

The surround channels look more complicated than they are. The functions fc( ) and fs( ) direct the surround channels either to a path with a 90 degree phase shift relative to the front channels, or to a path with no phase shift. In the basic operation of the encoder, fc is one, and fs is zero, which means that only the path which uses the 90 degree phase shift is active.

crx controls the amount of negative cross feed for each surround channel and is typically 0.38. As in the previous encoder, the A and B outputs have an amplitude ratio of −0.38/0.91 when there is only an input to one of the surround channels. The amplitude ratio results in a steering angle of 22.5 degrees to the rear. As usual, the total power in the two output channels is unity (the sum of the squares of 0.91 and 0.38 is one).

While the output of this encoder is relatively simple when only one channel is driven, it becomes problematic when both surround inputs are driven at the same time. If the LS and the RS input are driven with the same signal (a common occurrence in film), all the signals at the summing nodes are in phase, so the total level in the output channels is 0.38+0.91, which is 1.29. This output level is too strong by the factor of 1.29, which is 2.2 dB. Therefore, active circuitry is included in the encoder that reduces the value of the function fc by up to 2.2 dB when the two surround channels are similar in level and phase.

Another error occurs when the two surround channels are similar in level and out of phase. In this case, the two attenuation factors subtract, so the A and B outputs have equal amplitude and phase, and a level of 0.91−0.38, which is 0.53. This signal will be decoded as a center direction signal, which is a severe error. The previous encoder design produced an unsteered signal under these conditions, which is reasonable. However, it is not reasonable that signals applied to the rear input terminals result in a center oriented signal. Thus, active circuitry is supplied, which increases the value of fs when the two rear channels are similar in level and antiphase. Mixing both the real path and the phase shifted path for the rear channels results in a 90 degree phase difference between the output channels A and B. This results in an unsteered signal, which is desired.

As previously mentioned, a surround encoder using the European standard attenuates the two surround channels by 3 dB and adds them into the front channels. Thus, the left rear channel is attenuated and added to the left front channel. A surround encoder using the European standard has many disadvantages when encoding multichannel film sound or recordings that have specific instruments in the surround channels. One such advantage is that both the loudness and the direction of these instruments will be incorrectly encoded. However, a surround encoder using the European standard works rather well with classical music, for which the two surround channels are primarily reverberation. The 3 dB attenuation of the European standard was carefully chosen through listening tests to produce encoding that is stereo-compatible. Therefore, the new encoder should include this 3 dB attenuation when classical music is being encoded. The presence of classical music can be detected through the relative levels of the front channels and the surround channels in the encoder.

A major function of the function fc in the surround channels is to reduce the level of the surround channels in the output mix by 3 dB when the surround channels are much softer than the front channels. Circuitry is provided to compare the front and rear levels, and reduce the value of fc to a maximum of 3 dB when the rear levels are 3 dB less than the front levels. Maximum attenuation is reached when the rear channels are 8 dB less strong than the front channels. This active circuit appears to work well and makes the new encoder compatible with a surround encoder using the European standard for classical music. The action of the active circuits causes instruments, which are intended to be strong in the rear channels, to be encoded with full level.

The real coefficient mixing path fs has another function for the surround channels. When a sound is moving from the left front input to the left rear input, active circuitry detects when these two inputs are similar in level and in phase. Under these conditions, fc is reduced to zero and fs is increased to one. This change to real coefficients in the encoding results in a more precise decoding of this type of pan. In practice, this function is probably not essential, but seems to be an elegant refinement.

There is an additional active circuit—a level detecting circuit. Level detecting circuits look at the phase relationship between the center channel and the front left and right. Some popular music recordings that use five channels mix the vocals into all three front channels. When there is a strong signal in all three inputs, the encoder output will have excessive vocal power, because the three front channels will add together in phase. When this occurs, active circuits increase the attenuation in the center channel by 3 dB to restore the power balance in the encoder output.

In summary, active circuits are provided to:

1. Reduce the level of the surround channels by 2.2 dB when the two channels are in phase;
2. Sufficiently, increase the real coefficient mixing path for the rear channels to create an unsteered condition when the two rear channels are out of phase;
3. Decrease the level of the surround channels by up to 3 dB when the surround level is much lower than the front levels;
4. Increase the level and negative phase of the rear channels when the level of the rear channels is similar to the level of the front channels;
5. Cause the surround channel mix to use real coefficients when a sound source is panning from a front input to the corresponding rear input;
6. Increase the level of the center channel in the encoder when the center level and the level of the front and surround inputs are approximately equal; and
7. Decrease the level of the center channel in the encoder when a there is a common signal in all three front inputs.

27. Frequency Dependent Circuits in the Decoder

FIG. 2 is a block diagram that includes frequency dependent circuits that follow the matrix in a five channel version of the decoder. The frequency dependent circuits include three sections: a variable low pass filter, a variable shelf filter, and a HRTF (Head Related Transfer Function) filter. The HRTF filter changes its characteristics depending on the value of the rear steering voltage c/s. The first two filters change their characteristics in response to a signal that is intended to represent the average direction of the input signals to the decoder during pauses between strongly steered signals. This signal is called the background control signal.

28. The Background Control Signal

One of the major goals of the current decoder is to optimally create a five channel surround signal from an ordinary two channel stereo signal. It is also highly desirable for the decoder to recreate a five channel surround recording that was encoded into two channels by the encoder described in this application. These two goals differ in the way in which the surround channels are perceived. With an ordinary stereo input, the majority of the sound needs to be in front of the listener. The surround speakers should contribute a pleasant sense of envelopment and ambience, but should not draw attention to themselves. With an encoded surround recording, the surround speakers need to be stronger and more aggressive.

To play both types of input optimally without any adjustment by the user, it is necessary to discriminate between a two channel recording and an encoded five channel recording. The background control signal is designed to make this discrimination. The background control signal ("BCS") is similar to and derived from the rear steering signal cs. BCS represents the negative peak value of cs. That is, when cs is more negative than BCS, BCS is made to equal cs. When cs is more positive than BCS, BCS slowly decays. However, the decay of BCS involves a further calculation.

Music of many types consists of a series of strong foreground notes, or in the case of a song, sung words. There is a background between the foreground notes that may consist of other instruments playing other notes or reverberation. The circuit that derives the BCS signal keeps track of the peak level of the foreground notes. When the current level is ~7 dB less than the peak level of the foreground, the level of cs is measured. The value of cs during the gaps between foreground peaks is used to control the decay of BCS. If the material in the gaps is reverberation, cs may tend to have a net rearward bias in a recording that was made by encoding a five channel original. This is because the reverberation on the rear channels of the original will be encoded with a rearward bias. The reverberation in an ordinary two channel recording will have no net rearward bias. cs for this reverberation will be zero or slightly forward.

BCS derived in this way tends to reflect the type of recording. Any time there is significant rear steered material, BCS will always be strongly negative. However, BCS can be negative even in the absence of strong steering to the rear if the reverberation in the recording has a net rearward bias. The filters that optimize the decoder for stereo versus surround inputs may be adjusted using BCS.

29. Frequency Dependent Circuits: Five Channel Version

The first of the filters in FIG. 2 is a simple 6 dB per octave low pass filter with an adjustable cutoff frequency. This filter is set to a value that is user adjustable when BCS is positive or zero, but is typically about 4 kHz. The cutoff frequency of the filter is raised as BCS becomes negative until BCS is more rearward than 22 degrees. At this point, the filter is not active. This low frequency filter makes the rear outputs less obtrusive when ordinary stereo material is played. In earlier decoders the filter was controlled by cs, and not by BCS.

The second filter is a variable shelf filter that implements the "sound stage" control in the current decoder. In the November '96 application, the "soundstage" control was implemented through the matrix elements using the "tv matrix" correction. The earlier decoders reduced the overall level of the rear channels when the steering was neutral or forward. In the new decoder, the matrix elements do not include the "tv matrix" correction. The second filter of FIG. 2 includes a low frequency section (the pole) that is fixed at 500 Hz and a high frequency section (the zero) that varies depending on user adjustment and BCS.

The high frequency section of the shelf filter is set equal to the low frequency section when the soundstage control is set to "rear" in the new decoders. In other words, the shelf has no attenuation, and the filter has flat response. However, the setting of the high frequency zero varies when the soundstage control is set to "neutral" in the new decoders. The zero moves to 710 Hz when BCS is positive or zero, resulting in a 3 dB attenuation of higher frequencies. The result is the same as that of the earlier decoders for the high frequencies. There is a 3 dB attenuation when the steering is neutral or forward. However, the low frequencies are not attenuated and come from the sides of the room with full level. This results in greater low frequency richness and envelopment, without the distracting high frequencies in the rear. The high frequency zero moves toward the pole as BCS becomes negative so that the shelf filter has an attenuation when BCS is about 22 degrees to the rear. While the action is similar when the soundstage control is set to "front", but the zero moves to 1 kHz when BCS is zero or positive. This gives the high frequencies an attenuation of 6 dB. Once again, the attenuation is removed as BCS goes negative.

The third filter is controlled by c/s and not by BCS. This filter is designed to emulate the frequency responses of the human head and pinnae when a sound source is approximately 150 degrees in azimuth from the front of the listener. This type of frequency response is called a "Head Related Transfer Function" or HRTF. These frequency response functions have been measured for many angles and for many different people. In general, there is a strong notch in the frequency response at about 5 kHz when a sound source is about 150 degrees from the front. A similar notch at about 8 kHz exists when a sound source is in front of a listener. Sound sources to the side of the listener do not produce these notches. The presence of the notch at 5 kHz is one of the ways in which the human brain detects that a sound source is behind the listener.

The current standard for five channel sound reproduction recommends that the two rear speakers be placed slightly behind the listener at +/−10 or 120 degrees from the front. This speaker position supplies good envelopment at low frequencies. However, listening rooms often do not have a size or shape appropriate for placing loudspeakers fully behind the listener and a side position is the best that can be achieved. However, a sound generated to the side of a listener does not produce the same level of excitement as a sound that is generated fully behind a listener. In addition, film directors often want a sound effect to come from behind the listener, and not from the side.

The HRTF filter in the decoder adds the frequency notches of a rear sound source so that a listener hears the sound as if it were generated further behind the listener than the actual positions of the loudspeakers. The filter is designed to vary with cs so that the filter is maximum when cs is positive or zero, which causes ambient sounds and reverberation to seem to be more behind the listener. The filter is reduced as cs becomes negative and is completely removed when cs is approximately −15 degrees. At this point, the sound source appears to come fully from the side. The filter is once again applied as cs goes further negative so that the sound source appears to go behind the listener. The filter is slightly modified to correspond to the HRTF function when cs is fully to the rear.

30. Frequency Dependent Circuits: The Seven Channel Version

FIG. 3 shows the frequency dependent circuits in the seven channel version of the decoder, which consisting of three sections. However, the second two sections can be combined into one circuit. The first two sections are identical to the two sections in the five channel decoder, and perform the same function. The third section is unique to the seven channel decoder. In version V1.11 and the November '96 application the side and rear channels had separate matrix elements. The action of the elements was such that the side and the rear outputs were identical, except for delay, when cs was positive or neutral. The two outputs remained identical until cs was more negative than 22 degrees. As the steering moved further to the rear, the side outputs were attenuated by 6 dB, and the rear outputs were boosted by 2 dB. This caused the sound to appear to move from the sides of the listener to the rear of the listener.

In the present decoder, the differentiation between the side output and the rear output is achieved by a variable shelf filter in the side output. The third shelf filter in FIG. 3 has no attenuation when cs is forward or zero. However, the zero in the shelf filter moves rapidly toward 1100 Hz when cs becomes more negative than 22 degrees, resulting in an about 7 dB attenuation of the high frequencies. Although this shelf filter has been described as a filter separate from the shelf filter that provides the "soundstage" function, the action of the two shelf filters can be combined into a single shelf through suitable control circuitry.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A method for decoding a pair of audio input signals into a plurality of output channels, comprising the steps of:

determining a plurality of matrix coefficients that each defines a surface as a function of one or more steering angles, where the surface includes a plurality of quadrants and is continuous between the plurality of quadrants, and where the one or more steering angles define a steering; and determining the plurality of output channels as a combination of the audio input signals and the plurality of matrix coefficients.

2. The method of claim 1, where the one or more steering angles includes a cs steering angle that defines a cs axis for the surface.

3. The method of claim 2, where determining a plurality of matrix coefficients includes including a boost along the cs axis for at least one of the plurality of matrix coefficients.

4. The method of claim 3, where the boost equals about 3 dB when cs equals about zero degrees to about 22.5 degrees.

5. The method of claim 3, where the boost decreases as cs increases from about 22.5 degrees to about 45 degrees.

6. The method of claim 1, where the plurality of output channels includes a left front output signal, a right front output signal, a center output signal, a left surround output signal, and a right surround output signal.

7. The method of claim 6, where the pair of audio input signals includes a center component.

8. The method of claim 7, where determining the plurality of matrix coefficients further includes defining at least one of the matrix coefficients so that the left front and right front output signals include an amount of the center component when the steering is to about a center.

9. The method of claim 8, where determining the plurality of matrix coefficients further includes including an amount of the center component in at least another of the matrix coefficients that makes a total power of the plurality of output channels equal to about a total power of the pair of input channels.

10. The method of claim 8, where determining the plurality of matrix coefficients further includes limiting one of the one or more steering angles when the center component is about 6 dB stronger in one of the plurality of output channels.

11. The method of claim 10, where the one of the one or more steering angles is limited when the steering is to about a center.

12. The method of claim 6, where determining the plurality of matrix coefficients further includes increasing a loudness of the center output channel so that a total power of the plurality of output channels equals about a total power of the pair of input channels.

13. The method of claim 12, where the loudness of the center output channel is increased when the steering is to about a center.

14. The method of claim 12, where the loudness of the center output channel is increased when a level in the left front output channel, the right front output channel, and the center output channel are about equal.

15. The method of claim 2, where determining a plurality of matrix coefficients includes including a cut along the cs axis for at least one of the plurality of matrix coefficients.

16. A decoder for decoding a pair of audio input signals into a plurality of output channels, comprising:

at least one matrix comprising a plurality of matrix coefficients that define a surface as a function of one or more steering angles, where the surface includes a plurality of quadrants and is continuous between the plurality of quadrants, and where the one or more steering angles define a steering; and a processor that determines the plurality of output channels as a combination of the audio input signals and the plurality of matrix coefficients.

17. The decoder of claim 16, the one or more steering angles includes a cs steering angle that defines a cs axis for the surface.

18. The decoder of claim 17, where the plurality of matrix coefficients includes a boost along the cs axis for at least one of the plurality of matrix coefficients.

19. The decoder of claim 18, where the boost equals about 3 dB when cs equals about zero degrees to about 22.5 degrees.

20. The decoder of claim 18, where the boost decreases as cs increases from about 22.5 degrees to about 45 degrees.

21. The decoder of claim 16, where the plurality of output channels includes a left front output signal, a right front output signal, a center output signal, a left surround output signal, and a right surround output signal.

22. The decoder of claim 21, where the pair of audio input signals includes a center component.

23. The decoder of claim 22, where the plurality of matrix coefficients further includes at least one of the matrix coefficient so that the left front and right front output signals include an amount of the center component when the steering is to about a center.

24. The decoder of claim 23, where the plurality of matrix coefficients further includes an amount of the center component in at least another of the matrix coefficients that makes a total power of the plurality of output channels equal to about a total power of the pair of input channels.

25. The decoder of claim 23, where the plurality of matrix coefficients limits one of the one or more steering angles when the center component is about 6 dB stronger in one of the plurality of output channels.

26. The decoder of claim 25, where the one of the one or more steering angles is limited when the steering is to about a center.

27. The decoder of claim 21, where the plurality of matrix coefficients increases a loudness of the center output channel so that a total power of the plurality of output channels equals about a total power of the pair of input channels.

28. The decoder of claim 27, where the loudness of the center output channel is increased when the steering is to about a center.

29. The decoder of claim 27, where the loudness of the center output channel is increased when a level in the left front output channel, the right front output channel, and the center output channel are about equal.

30. The decoder of claim 17, where the plurality of matrix coefficients includes a cut along the cs axis for at least one of the plurality of matrix coefficients.

* * * * *